US008178267B2

(12) United States Patent
Hirose et al.

(10) Patent No.: US 8,178,267 B2
(45) Date of Patent: May 15, 2012

(54) ELECTROPHOTOGRAPHIC TONER

(75) Inventors: Naohiro Hirose, Tokyo (JP); Meizo Shirose, Tokyo (JP); Kaori Soeda, Tokyo (JP); Shiro Hirano, Tokyo (JP); Shinya Obara, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 539 days.

(21) Appl. No.: 12/469,063

(22) Filed: May 20, 2009

(65) Prior Publication Data

US 2009/0291377 A1 Nov. 26, 2009

(30) Foreign Application Priority Data

May 23, 2008 (JP) ..... 2008-135428

(51) Int. Cl.
*G03G 9/09* (2006.01)

(52) U.S. Cl. ..... 430/107.1; 430/108.1

(58) Field of Classification Search ..... 430/107.1, 430/108.1
See application file for complete search history.

(56) References Cited

U.S. PATENT DOCUMENTS

| | | | | |
|---|---|---|---|---|
| 2006/0093935 | A1* | 5/2006 | Ono et al. | 430/108.1 |
| 2006/0257774 | A1* | 11/2006 | Daifuku et al. | 430/108.21 |
| 2007/0092819 | A1* | 4/2007 | Daifuku et al. | 430/108.1 |
| 2008/0113284 | A1* | 5/2008 | Hayashi et al. | 430/45.5 |
| 2009/0291382 | A1* | 11/2009 | Hirose et al. | 430/108.21 |

FOREIGN PATENT DOCUMENTS

| | | |
|---|---|---|
| JP | 2006154363 | 6/2006 |
| JP | 2006267741 | 10/2006 |
| JP | 2007286148 | 11/2007 |
| JP | 2007316591 | 12/2007 |

* cited by examiner

*Primary Examiner* — Hoa V Le
(74) *Attorney, Agent, or Firm* — Lucas & Mercanti, LLP

(57) ABSTRACT

A set of toners comprising a yellow toner, a magenta toner, a cyan toner and a black toner for forming a full color image with an electrophotographic method, wherein the yellow toner comprises toner particles containing at least one pigment selected from the group consisting of C.I. Pigment Yellow 74, C.I. Pigment Yellow 139, C.I. Pigment Yellow 155, C.I. Pigment Yellow 180 and C.I. Pigment Yellow 185; the magenta toner comprises toner particles containing a dye represented by Formula (X-1) and a metal compound represented by Formula (1); and the cyan toner comprises toner particles containing a silicon phthalocyanine represented by Formula (2):

Formula (X-1)

-continued
Formula (1)
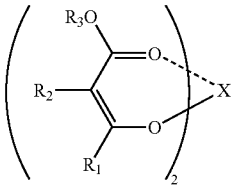
-continued
Formula (2)
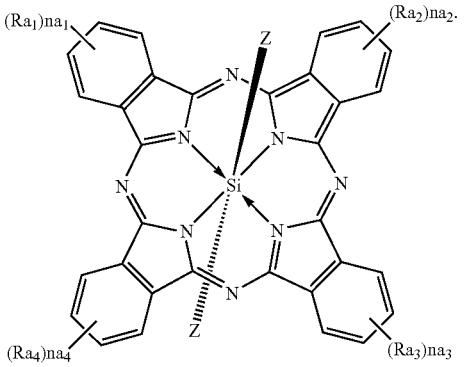
7 Claims, 3 Drawing Sheets

ELECTROPHOTOGRAPHIC TONER

This application is based on Japanese Patent Application No. 2008-135428 filed on May 23, 2008 with Japan Patent Office, the entire content of which is hereby incorporated by reference.

TECHNICAL FIELD

The present invention relates to a set of electrophotographic toners (it is also called a color toner kit) used for forming a color image with an electrophotographic method. The present invention relates to color toners which can stably provide a full color image of vivid colors without turbidness of colors. More specifically, the present invention relates to a set of color toners enabling to produce a full color image having an expanded color reproduction range (it is also called as a color gamut) and superior color balance by improving the color balance of each color (yellow, magenta, cyan, blue, red and green) and by reducing the bias of color reproduction.

BACKGROUND

In recent years, production of a full color print can be achieved via the electrophotography system using the toner for electrostatic charge image development (hereinafter it is called as an electrophotographic toner or simply a toner) in addition to a monochrome print which is most representative for a document print. Since such full color image forming apparatus can produce a required number of prints on demand without preparing a printing plate for a usual printing process, it is increasingly used in a small volume printing field having many opportunities of small-quantity print order (for example, refer to Patent Document 1).

In producing a full color print, such as a catalog and an advertisement print, with a toner, the toner used is required to produce an image which exhibits a faithful color reproduction to the original. In full color image formation, yellow, magenta and cyan color toners each are superimposed to reproduce a target color image. In order to realize faithful color reproduction, it was required for the color toners to improve the color reproduction property.

Therefore, investigation of various colorants (it is also called as coloring matters or coloring materials) has so far been made for the purpose of improving the color reproduction of a color toner.

An example of typical magenta colorants for color toners is a quinacridone pigment. The toner incorporating a quinacridone pigment has outstanding light resistance and has a preferable magenta tone, therefore, a quinacridone pigment is used for general-purpose. However, this quinacridone pigment has a problem of dispersibility and the toner incorporating a quinacridone pigment tends to produce a turbid color at the time of a color pile. It is difficult to satisfy the request to produce a print of the image of the computer graphics or the high saturation display which are becoming highly required in recent years.

Instead of using solely a quinacridone pigment, the system in which other dye is added to a quinacridone pigment is known in order to increase color saturation (for example, refer to Patent Document 1). Furthermore, the proposal is made also about the system which uses a combination of a quinacridone pigment and a naphthol pigment (for example, refer to Patent Document 2). Moreover, it is also known the combined use with an anthraquinone pigment (for example, refer to Patent Document 3).

However, all of these proposed systems are inferior in light resistance to the system solely using a quinacridone pigment which exhibits high light resistance as a magenta pigment. They had a problem which cannot keep the color stable when the print is used over a long period of time.

Furthermore, in order to form an image with higher color saturation, a proposal is made in which the toner incorporating the coloring matter composed of a metallic compound and a dye (for example, Patent Document 4).

However, it is difficult to secure a large color region because, even if a certain specific color region is expanded and color saturation is increased, color saturation balances tend to be lowered. Especially, when color reproduction according to a display was performed, there occurs a problem that only a specific color region is approaching to the color reproduction range of sRGB used as a standard made by IEC (International Electrotechnical Commission) in October 1998), and color reproduction in all of the color regions cannot be performed.

Patent Document 1: Unexamined Japanese patent application publication (hereafter it is called as JP-A) 2007-286148

Patent Document 2: JP-A 2006-267741

Patent Document 3: JP-A 2006-154363

Patent Document 4: JP-A 2007-316591

SUMMARY

An object of the present invention is to provide a set of color toners which enable to produce a preferable full color image having a wide color reproduction range, especially to produce a color image achieving a color reproduction range of a display which is approaching nearer to sRGB reproduction region. An object of the present invention is to provide a full color image forming method using the same color toners. An object of the present invention is to provide an image formation method enabling to form a print which has improved the balance of the color region of each color (yellow, magenta, cyan, blue, red and green), and secured the color reproduction range large by controlling the bias of color reproduction to reduce the bias of color reproduction.

The present inventor diligently investigated and found out the followings. The afore-mentioned problem can be solved by using a set of toners composed of a yellow toner, a magenta toner and a cyan toner each containing a specific colorant for forming an image. The present invention has been achieved by this specific set of toners.

One of the embodiments of the present invention is a method for forming an electrophotographic image using a set of toners comprising a yellow toner, a magenta toner, a cyan toner and a black toner, wherein the yellow toner comprises at least one pigment selected from the group consisting of C.I. Pigment Yellow 74, C.I. Pigment Yellow 139, C.I. Pigment Yellow 155, C.I. Pigment Yellow 180 and C.I. Pigment Yellow 185;

the magenta toner comprises a dye represented by Formula (X-1) and a metal compound represented by Formula (1); and the cyan toner comprises a silicon phthalocyanine represented by Formula (2).

Formula (X-1)

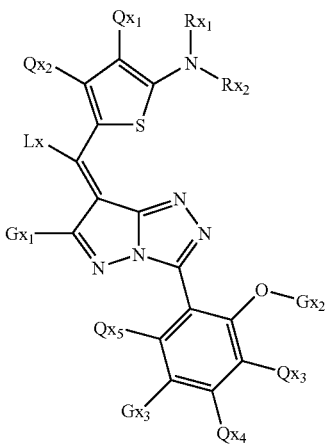

In Formula (X-1), $Rx_1$ and $Rx_2$ each independently represent an alkyl group; Lx represents a hydrogen atom or an alkyl group; $Gx_1$ represents an alkyl group of 2 or more carbon atoms; $Gx_2$ represents an alkyl group or an aromatic hydrocarbon; $Gx_3$ represents a hydrogen atom, a halogen atom, $Gx_4$—CO—NH—, or $Gx_5$—N($Gx_6$)-CO—, provided that $Gx_4$ is a substituent, and $Gx_5$ and $Gx_6$ each independently represents a hydrogen atom or a substituent; and $Qx_1$, $Qx_2$, $Qx_3$, $Qx_4$, $Qx_5$ each independently represents a hydrogen atom or a substituent.

Formula (1)

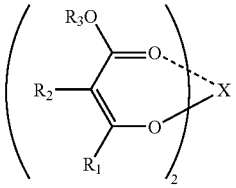

In Formula (1), $R_1$ and $R_2$ each independently represent a hydrogen atom, an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group or a nitro group, provided that one of $R_1$ and $R_2$ is an electron withdrawing group; $R_3$ represents an alkyl group, an alkenyl group, an alkynyl group, an aryl group or a heterocyclic group, provided that a group represented by $R_3$ contains 3 carbon atoms or more; and X represents Cu, Ni, or Co.

Formula (2)

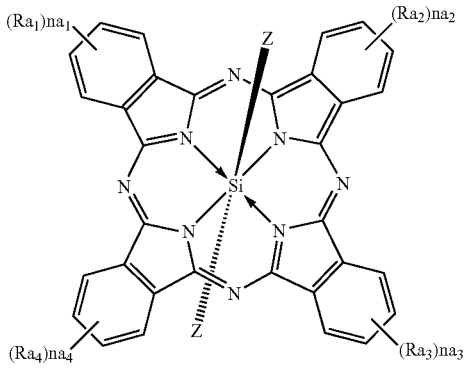

In Formula (2), Z represents a hydroxyl group, a chlorine atom, an aryloxy group of 6 to 18 carbon atoms, an alkoxyl group of 1 to 22 carbon atoms or a group represented by Formula (IV). $R_{a1}$, $R_{a2}$, $R_{a3}$ and $R_{a4}$ each independently represent a substituent. $n_{a1}$, $n_{a2}$, $n_{a3}$ and $n_{a4}$ each independently represent an integer of 0 to 4.

Formula (IV)

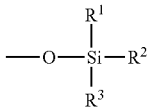

In Formula (IV), $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms. $R^1$, $R^2$ and $R^3$ each may be the same or different.

Another embodiment of the present invention is a set of toners used for forming a full color image with an electrophotographic method. The set of toners comprises a yellow toner, a magenta toner, a cyan toner and a black toner, wherein the yellow toner comprises at least one pigment selected from the group consisting of C.I. Pigment Yellow 74, C.I. Pigment Yellow 139, C.I. Pigment Yellow 155, C.I. Pigment Yellow 180 and C.I. Pigment Yellow 185;

the magenta toner comprises a dye represented by Formula (X-1) and a metal compound represented by Formula (1); and the cyan toner comprises a silicon phthalocyanine represented by Formula (2).

According to the present invention, it can be achieved to provide a set of color toners and a full color image forming method using the same color toners which enable to produce a preferable full color image having a wide color reproduction range, especially to produce a color image achieving a color reproduction range a display which is approaching nearer to sRGB color reproduction range.

DESCRIPTION OF THE PREFERRED EMBODIMENTS

Figure 1:
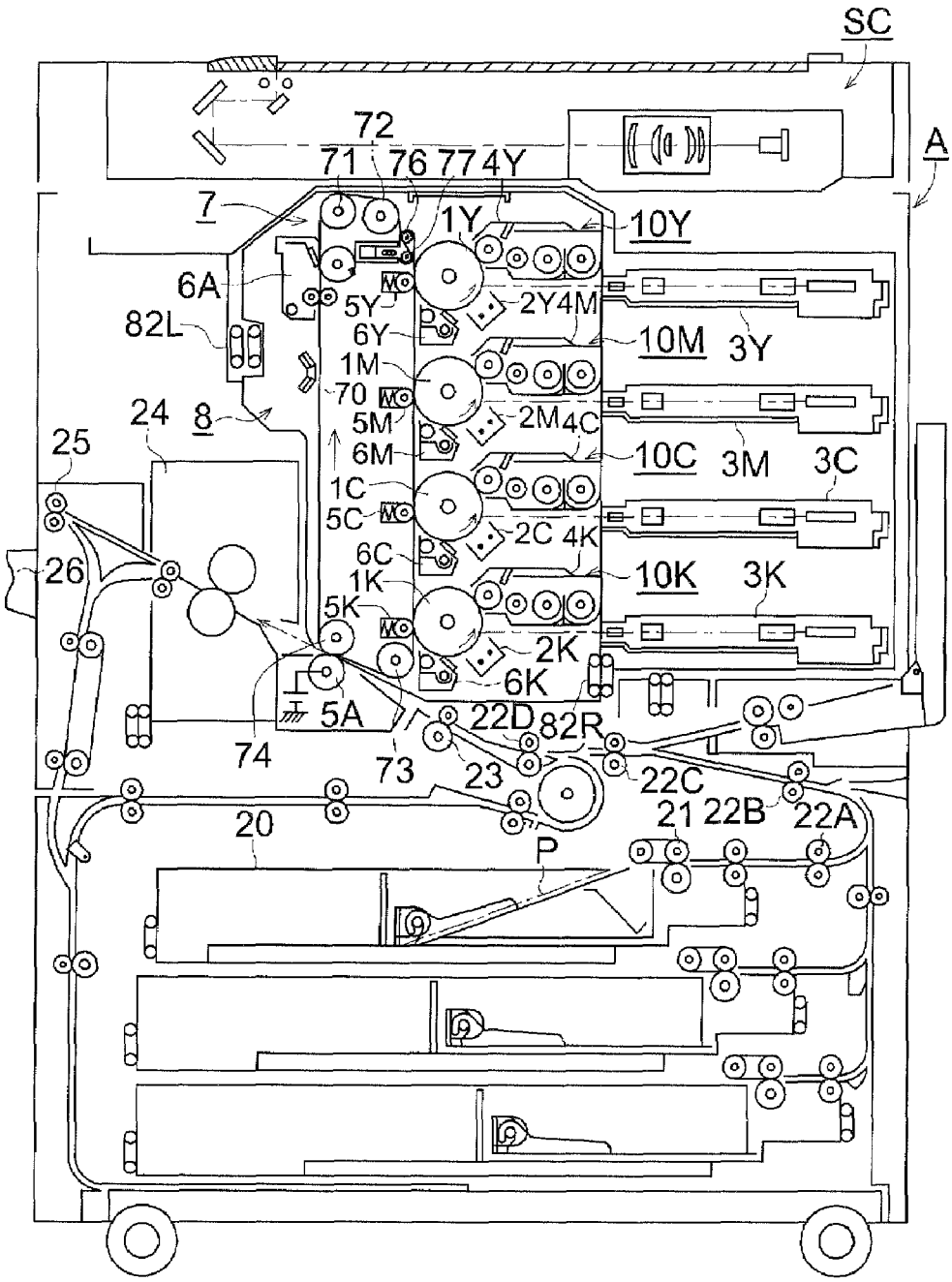
FIG. 1 illustrates an example of an image forming apparatus in which the toner of the present invention is usable as a two-component developer.

As a result of diligent investigation by the present inventors, the following invention was found.

In an image forming method using the toner comprising a colorant and a binder resin, more specifically, in an image forming method for producing a full color image using a yellow toner, a magenta toner, a cyan toner and a black toner, the specific combination of colorants and a metal compound was found to produce an excellent color image. The specific combination of colorants and a metal compound is as follows: a yellow toner comprising a yellow pigment selected from the group consisting of C.I. Pigment Yellow 74, C.I. Pigment Yellow 139, C.I. Pigment Yellow 155, C.I. Pigment Yellow 180, C.I. and Pigment Yellow 185; a magenta toner comprising a dye represented by Formula (X-1) and a metal compound represented by Formula (1); and a cyan toner comprising a silicon phthalocyanine represented by Formula (2). By using the toners having the above-described composition, It was found out that a full color image without color turbidness and a vivid color has been produced by using the toners having the above-described composition.

Moreover, it found out that it was stabilized and a good full color picture could be formed by these toners. Further, it found out that an excellent full color image can be produce stably by using the toners having the above-described composition. In particular, by improving the balance of the color region of each color (yellow, magenta, cyan, blue, red and green) and by reducing the bias of color reproduction, it can be achieved to secure the color reproduction range large and to realize a full color image having a reduced bias of color reproduction.

The present invention has achieved to provide an image forming method which enables to produce a full color image of a large color reproduction range exhibiting a vivid color without color turbidness, and the image forming method can stably produce an excellent full color image. Especially, by improving the balance of the color region of each color (yellow, magenta, cyan, blue, red and green) and by decreasing the bias of color reproduction range, the expanded color reproduction range has been acquired as a result and excellent color balance has been achieved.

This present inventors succeeded in achieving to produce a full color image having a color reproducing property which is similar to that of an electric display. This was realized by a set of color toners of yellow, magenta, and cyan toner, in each toner using a specific color material. That is, it found out that it was important to choose the color material of each color respectively in consideration of the balance of the color reproduction instead of simply by using the color material of a large color region.

In the color reproduction range of a display, which is expressed by sRGB, the blue domain occupies a very large color region. However, since there is expansion of a green domain when forming a color with an additive color process supposing the color reproduction range of this portion (blue) is emphasized, it is likely to produce a deformation in the color region of a yellow part or a cyan part, and as a result, the balance of a color will collapse. As a result, although the color reproduction range is widen, the formed color image will give a sense of incongruity in color reproduction.

The present inventors have achieved an improved color reproduction range by using the aforesaid combination of these color materials. In particular: red (the range near 45 degrees of hue angles); cyan (the range near 225 degrees of hue angles); green (the range near 135 degrees of hue angles), magenta (the range near 315 degrees of hue angles) are larger than the combination of the conventional color material. Moreover, red (the range near 45 degrees of hue angles), green (the range near 135 degrees of hue angles), and magenta (the range near 315 degrees of hue angles) were able to be made larger narrower than sRGB, and cyan (the range near 225 degrees of hue angles) was able to be made larger than sRGB.

As a consequence, it can be achieved to improve the balance of the color region of each color (yellow, magenta, cyan, blue, red and green), and it can control the bias of color reproduction. The color reproduction range has been kept large and an excellent color balance can be obtained.

The present invention will be detailed below.

First, a dye represented by Formula (X-1) and used in the present invention will be described. A dye represented by Formula (X-1) will also be called as "Compound (X-1)".

Formula (X-1)

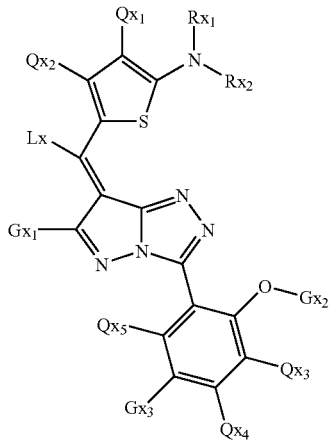

In Formula (1), $Rx_1$ and $Rx_2$ each independently represent an alkyl group; Lx represents a hydrogen atom or an alkyl group; $Gx_1$ represents an alkyl group of 2 or more carbon atoms; $Gx_2$ represents an alkyl group or an aromatic hydrocarbon; $Gx_3$ represents a hydrogen atom, a halogen atom, $Gx_4$—CO—NH—, or $Gx_5$—N($Gx_6$)-CO—, provided that $Gx_4$ is a substituent, and $Gx_5$ and $Gx_6$ each independently represents a hydrogen atom or a substituent; and $Qx_1$, $Qx_2$, $Qx_3$, $Qx_4$, $Qx_5$ each independently represents a hydrogen atom or a substituent.

Here, when $Gx_4$, $Gx_5$ and $Gx_6$ each represent a substituent, they preferably indicate: an alkoxyl group, an aryloxy group, an alkylthio group or an alkoxycarbonyl group. When $Qx_1$, $Qx_2$, $Qx_3$, $Qx_4$ and $Qx_5$ each represent a substituent, they preferably indicate: an alkoxyl group, an aryloxy group, an alkylthio group, an alkoxycarbonyl group or a halogen atom.

As described above, $Rx_1$ and $Rx_2$ each independently represent an alkyl group. Examples of alkyl group are a straight chain alkyl group, a branched alkyl group and a cycloalkyl group. $Rx_1$ and $Rx_2$ may be the same or different alkyl group.

Examples of a straight chain alkyl group and a branched alkyl group are; a methyl group, an ethyl group, a propyl group, an isopropyl group, n-butyl group, an isobutyl group, a tert-butyl group, a pentyl group, an amyl group, an isoamyl group, a hexyl group, an octyl group, a dodecyl group, a tridecyl group, a tetradecyl group and a pentadecyl group.

Examples of a cycloalkyl group are: a cyclopropyl group, a cyclobutyl group, a cyclopentyl group, a cyclohexyl group and a 4-tert-butylcyclohexyl group. Among these alkyl groups, most preferred are alkyl groups of a straight chain alkyl group and a branched alkyl group.

A preferable compound represented by Formula (X-1) has a total carbon atom number in an alkyl group of $Rx_1$ and an alkyl group $Rx_2$ is equal to 8 or more, more preferably 12 or more, and still more preferably 16 or more.

An alkyl group represented by $Rx_1$ and $Rx_2$ is preferably an unsubstituted alkyl group or an alkyl group substituted with an alkoxyl group, most preferably an unsubstituted alkyl group.

An alkyl group represented by $Rx_1$ and $Rx_2$ may be substituted with an alkoxyl group or other group. Substituents which may be substituted with an alkyl group is not specifically limited. Examples of such substituents include: a straight chain alkyl group, a branched alkyl group and a cycloalkyl group, an alkenyl group, an alkynyl group, an aromatic hydrocarbon group, a heterocyclic group, an alkoxyl group, an aryloxy group, an alkylthio group an arylthio group and an alkoxycarbonyl group.

Examples of an alkenyl group include: a vinyl group and an allyl group. Examples of an alkynyl group include: an ethynyl group and a propargyl group. Examples of an aryl group include: a phenyl group and a naphthyl group.

Examples of an aromatic heterocyclic group include: a furyl group, a thienyl group, a pyridyl group, a pyridazyl group, a pyrimidyl group, a pyrazyl group, a triazyl group, a benzimidazolyl group, a benzoxazolyl group, a pyrazolyl group, a quinazolyl group and a phthalazyl group. Examples of a heterocyclic group include: a pyrrolidyl group, an imidazolidyl group, a morpholyl group and an oxazolidyl group.

Examples of an alkoxyl group include: a methoxy group, an ethoxy group, a propyloxy group, a pentyloxy group, an hexyloxy group, an octyloxy group and a dodecyloxy group. Examples of a cycloalkoxy group include: a cyclopentyloxy group and a cyclohexyloxy group. Examples of an aryloxyl group include: a phenoxy group and a naphthyloxy group.

Examples of an alkylthio group include: a methylthio group, an ethylthio group, a propylthio group, a pentylthio group, a hexylthio group, an octylthio group, and a dodecylthio group. Examples of a cycloalkylthio group include: cyclopentylthio group and a cyclohexylthio group. Examples of an arylthio group include: a phenylthio group and a naphthylthio group.

Examples of an alkoxycarbonyl group include: a methyloxycarbonyl group, an ethyloxycarbonyl group, a butyloxycarbonyl group, an octyloxycarbonyl group, and a dodecyloxycarbonyl group. Examples of an aryloxycarbonyl group include: a phenyloxycarbonyl group and a naphthyloxycarbonyl group.

Examples of a phosphoryl group include: a methoxy phosphoryl group and a diphenyl phosphoryl group. Examples of a sulfamoyl group include: an aminosulfonyl group, a methylaminosulfonyl group, a dimethylaminosulfonyl group, a butylaminosulfonyl group, a hexylaminosulfonyl group, a cyclohexylaminosulfonyl group, an octylaminosulfonyl group, a dodecylaminosulfonyl group, a phenylaminosulfonyl group, a naphthylaminosulfonyl group and a 2-pyridylaminosulfonyl group.

Examples of an acyl group include: an acetyl group, an ethylcarbonyl group, a propylcarbonyl group, a pentylcarbonyl group, a cyclohexylcarbonyl group, an octylcarbonyl group, a 2-ethylhexylcarbonyl group, a dodecylcarbonyl group, a phenylcarbonyl group, a naphthylcarbonyl group and a pyridylcarbonyl group. Examples of an acyloxy group include: an acetyloxy group, an ethylcarbonyloxy group, a butylcarbonyloxy group, an octylcarbonyloxy group, a dodecylcarbonyloxy group and a phenylcarbonyloxy group.

Examples of an amido group include: a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a phenylcarbonylamino group and a naphthylcarbonylamino group.

Examples of a carbamoyl group include: an aminocarbonyl group, a methylaminocarbonyl group, a dimethylaminocarbonyl group, a propylaminocarbonyl group, a pentylaminocarbonyl group, a cyclohexylaminocarbonyl group, an octylaminocarbonyl group, a 2-ethylhexylaminocarbonyl group, a dodecylaminocarbonyl group, a phenylaminocarbonyl group, a naphthylaminocarbonyl group and a 2-pyridylaminocarbonyl group.

Examples of a ureido group include: a methylureido group, an ethylureido group, a pentylureido group, a cyclohexylureido group, an octylureido group, a dodecylureido group, a phenylureido group, a naphthylureido group, and a 2-oyridylaminoureido group. Examples of a sulfinyl group include: a methylsulfinyl group, an ethylsulfinyl group, a butylsulfinyl group, a cyclohexylsulfinyl group, a 2-ethylhexylsulfinyl group, a dodecylsulfinyl group, a phenylsulfinyl group, a naphthylsulfinyl group and a 2-pyridylsulfinyl group.

Examples of an alkylsulfonyl group: a methylsulfonyl group, an ethylsulfonyl group, a butylsulfonyl group, a cyclohexylsulfonyl group, a 2-ethylhexylsulfonyl group. Examples of an arylsulfonyl group: a phenylsulfonyl group, a naphthylsulfonyl group and a 2-pyridylsulfonyl group.

Examples of an amino group include: an amino group, an ethylamino group, a dimethylamino group, a butylamino group, a dibutylamino group, a cyclopentylamino group, a 2-ethylhexyl amino group, a dodecylamino group, an anilino group, a naphthylamino group, and a 2-pyridylamino group. Examples of an azo group include a phenylazo group. Examples of an alkylsulfonyloxy group include a methanesulfinyloxy group. Further groups to be cited include: a cyano group; a nitro group; a halogen atom such as a fluorine atom, a chlorine atom and a bromine atom; and a hydroxyl group.

These substituents may be further substituted with other substituents. Preferable substituents which may be further substituted include: in addition to the afore-mentioned alkoxyl group, an aromatic hydrocarbon group, a cycloalkoxy group, a halogen atom and a hydroxyl group.

Lx represents a hydrogen atom or an alkyl group. Among these groups, a hydrogen atom is preferable. When Lx is an alkyl group, this alkyl group is synonymous with an alkyl group represented by $Rx_1$ and $Rx_2$. It is preferable that an alkyl group has 1 to 5 carbon atoms, and a methyl group and an ethyl group are more preferable among these alkyl groups.

$Gx_1$ represents an alkyl group of 2 or more carbon atoms. They may be a straight chain alkyl group, a branched alkyl group and a cycloalkyl group. Examples of a straight chain alkyl group and a branched alkyl group include: an ethyl group, a propyl group, an isopropyl group, n-butyl group, an isobutyl group, a tert-butyl group, a pentyl group, an amyl group, an isoamyl group, a hexyl group, an octyl group, a dodecyl group, a tridecyl group, a tetradecyl group, a pentadecyl group. Examples of a cycloalkyl group include: a cyclopropyl group, a cyclobutyl group, a cyclopentyl group, a cyclohexyl group and a 4-tert-butylcyclohexyl group. Among them a branched alkyl group is preferred, and a tert-butyl group is most preferred.

$Gx_2$ represents an alkyl group or an aromatic hydrocarbon group; an alkyl group is synonymous with an alkyl group represented by $Rx_1$ and $Rx_2$; and examples of an aromatic hydrocarbon group include a phenyl group and a naphthyl group. Among these groups, an alkyl group is preferable. More preferred is an alkyl group of 1 to 5 carbon atoms, and specifically preferred are a methyl group and an ethyl group.

$Gx_3$ represents a hydrogen atom, a halogen atom or $Gx_4$—CO—NH—, $Gx_5$—N($Gx_6$)-CO—. Among them, a hydrogen atom is preferable. $Gx_4$ represents a substituent, examples of which are the same substituents that may be substituted with an alkyl group represented by $Rx_1$ and $Rx_2$. Preferable substituents are the same alkyl group represented by $Rx_1$ and $Rx_2$ or an aromatic hydrocarbon group.

$Gx_5$ and $Gx_6$ each represent a hydrogen atom or a substituent. Examples of a substituent are the same substituents that may be substituted with an alkyl group represented by $Rx_1$ and $Rx_2$. Preferable substituents are the same alkyl group represented by $Rx_1$ and $Rx_2$.

$Qx_1$, $Qx_2$, $Qx_3$, $Qx_4$ and $Qx_5$ each independently represent a hydrogen atom or a substituent. Examples of a substituent are the same as $Gx_4$. It is preferable that $Qx_1$, $Qx_2$, $Qx_3$, $Qx_4$ and $Qx_5$ each independently represent a hydrogen atom, an alkyl group, a halogen atom or an alkoxyl group. It is more preferable the all of $Qx_1$, $Qx_2$, $Qx_3$, $Qx_4$ and $Qx_5$ are a hydrogen atom.

Examples of a compound represented by Formula (X-1) are shown below, however, the compounds which can be usable in the present invention are not limited bythem.

DX-1

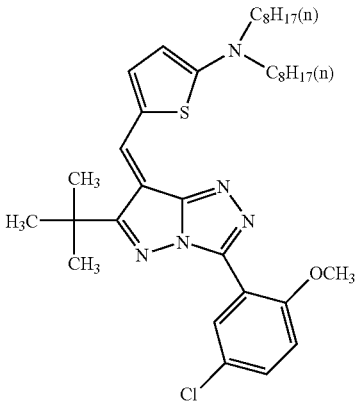

DX-2

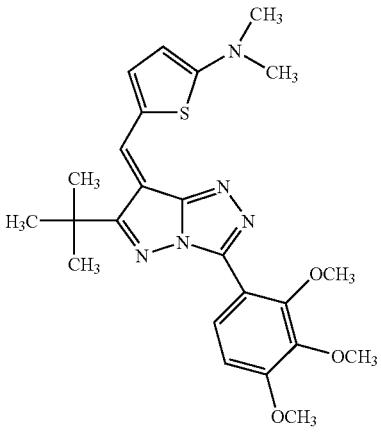

-continued

DX-3

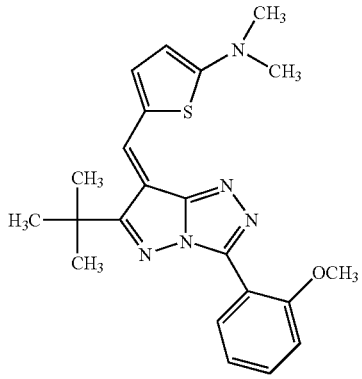

DX-4

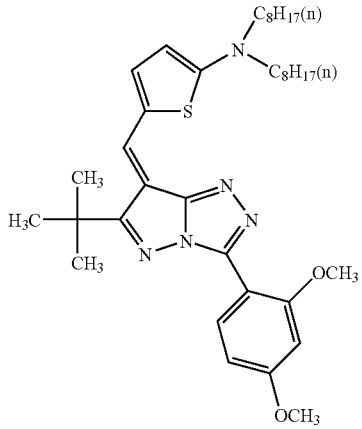

DX-5

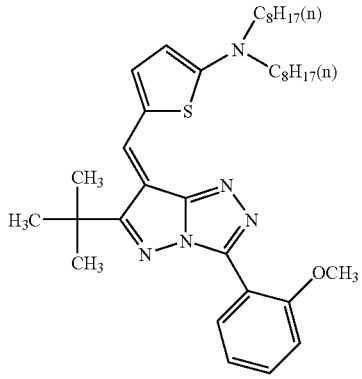

DX-6

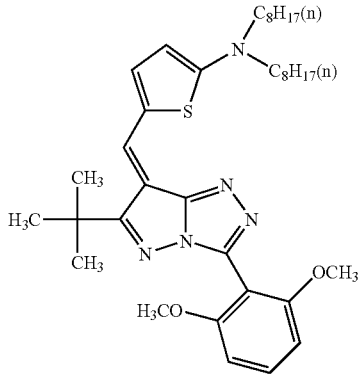

-continued
DX-7
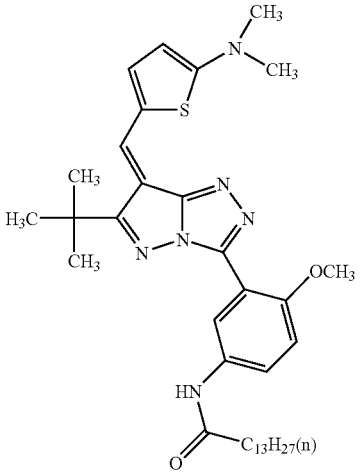
DX-8
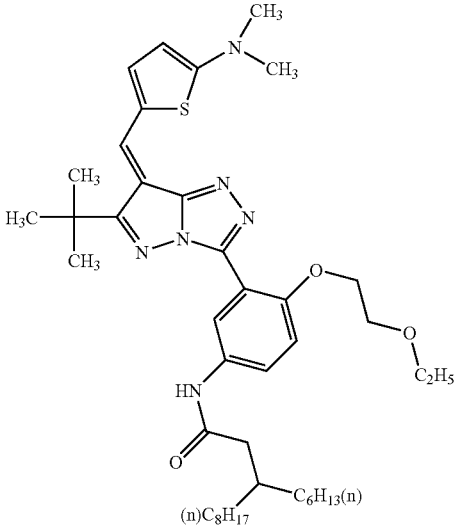
DX-9
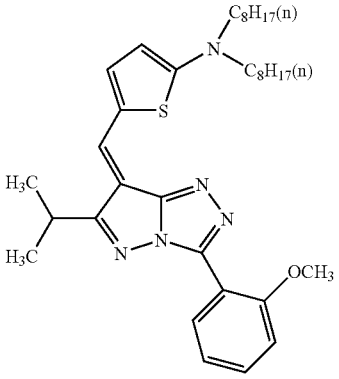
-continued
DX-10
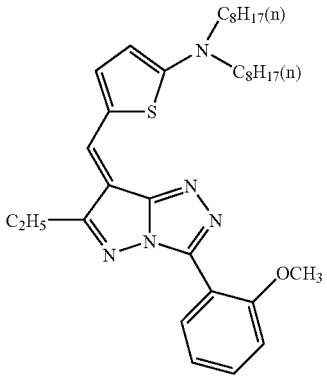
DX-11
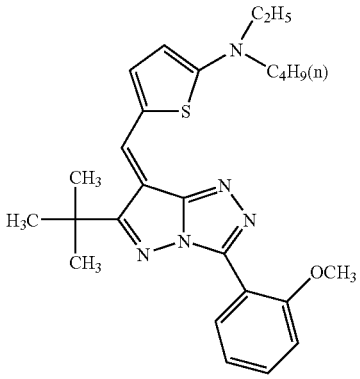
DX-12
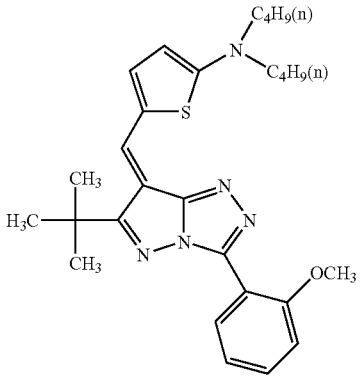
DX-13
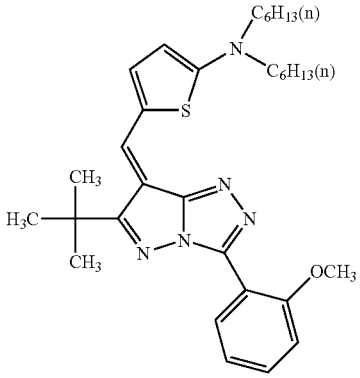

-continued
DX-14
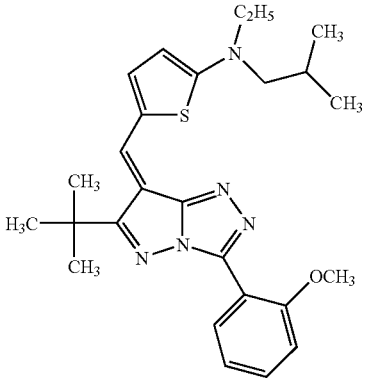
DX-15
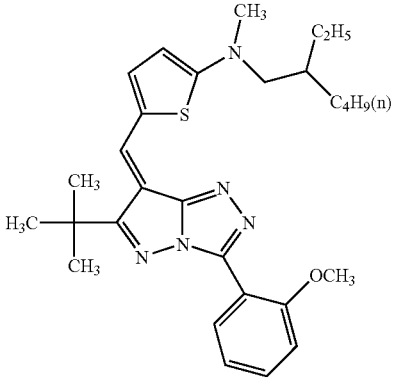
DX-16
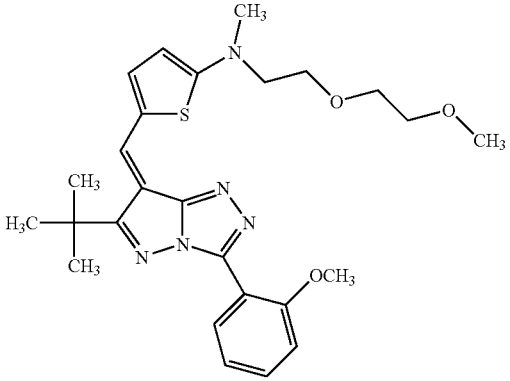
DX-17
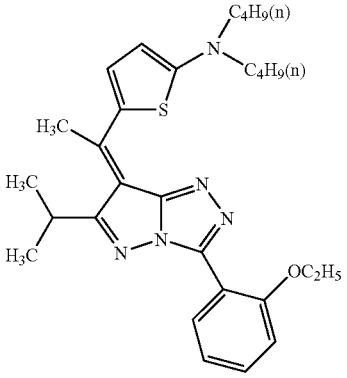
-continued
DX-18
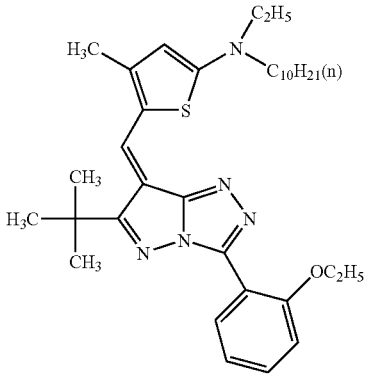
DX-19
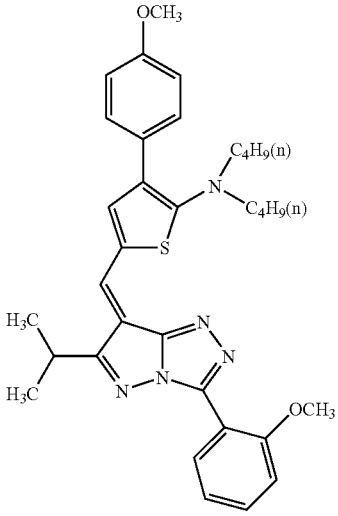
DX-20
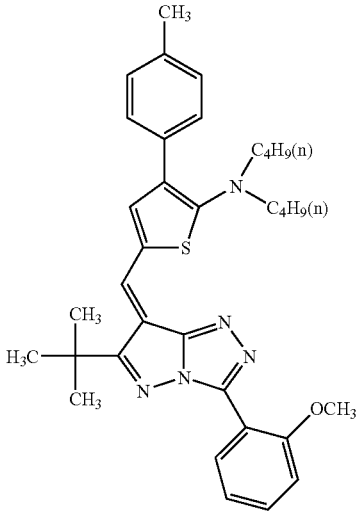

-continued

DX-21

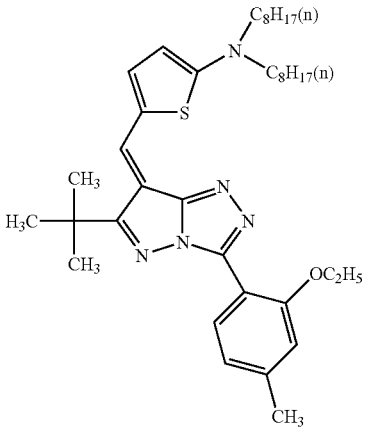

DX-22

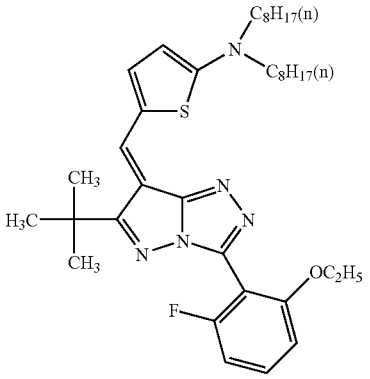

DX-23

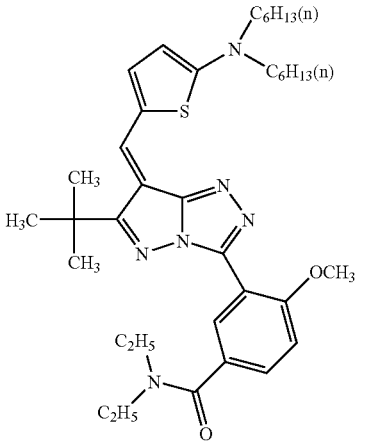

A metal compound represented by the following Formula (1) will be described.

Formula (1)

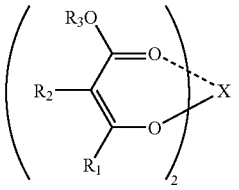

$R_1$ and $R_2$ that constitute a compound represented by Formula (1) each independently represent a hydrogen atom or a substituent. Examples of a substituent include: an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group and a nitro group. One of $R_1$ and $R_2$ is an electron withdrawing group. $R_3$ represents an alkyl group, an alkenyl group, an alkynyl group, an aryl group or a heterocyclic group, provided that a group represented by $R_3$ contains 3 carbon atoms or more. The carbon atoms contained in a ligand of the metal compound represented by Formula (1) is 25 or less.

Specific examples for R that constitutes a metal compound represented by Formula (1) will be described below.

Examples of an alkyl group include: a methyl group, an ethyl group, a propyl group, an isopropyl group, a tert-butyl group, a pentyl group, a hexyl group, an octyl group, a dodecyl group, a tridecyl group, a tetradecyl group and a pentadecyl group.

Examples of a trifluoroalkyl group include: a trifluoromethyl group, a trifluoroethyl group and trifluoropropyl group.

Examples of a cycloalkyl group include: a cyclopentyl group and a cyclohexyl group. Examples of an alkenyl group include: a vinyl group and an allyl group.

Examples of an alkynyl group include: an ethynyl group and a propargyl group. Examples of an aryl group include: a phenyl group and a naphthyl group.

Examples of an aromatic heterocyclic group include: a furyl group, a thienyl group, a pyridyl group, a pyridazyl group, a pyrimidyl group, a pyrazyl group, a triazyl group, an imidazolyl group, a pyrazolyl group, a thiazolyl group, a benzimidazolyl group, a benzoxazolyl group, a quinazolyl group and a phthalazyl group.

Examples of a heterocyclic group include: a pyrrolidyl group, an imidazolidyl group, a morpholyl group and an oxazolidyl group.

Examples of an alkoxyl group include: a methoxy group, an ethoxy group, a propyloxy group, a pentyloxy group, an hexyloxy group, an octyloxy group and a dodecyloxy group.

Examples of a cycloalkoxy group include: a cyclopentyloxy group and a cyclohexyloxy group.

Examples of an aryloxyl group include: a phenoxy group and a naphthyloxy group. Examples of an alkylthio group include: a methylthio group, an ethylthio group, a propylthio group, a pentylthio group, a hexylthio group, an octylthio group, and a dodecylthio group.

Examples of a cycloalkylthio group include: cyclopentylthio group and a cyclohexylthio group. Examples of an arylthio group include: a phenylthio group and a naphthylthio group.

Examples of an alkoxycarbonyl group include: a methyloxycarbonyl group, an ethyloxycarbonyl group, a butyloxycarbonyl group, an octyloxycarbonyl group, and a dodecyloxycarbonyl group. Examples of an aryloxycarbonyl group include: a phenyloxycarbonyl group and a naphthyloxycarbonyl group.

Examples of a sulfamoyl group include: an aminosulfonyl group, a methylaminosulfonyl group, a dimethylaminosulfonyl group, a butylaminosulfonyl group, a hexylaminosulfonyl group, a cyclohexylaminosulfonyl group, an octylaminosulfonyl group, a dodecylaminosulfonyl group, a phenylaminosulfonyl group, a naphthylaminosulfonyl group and a 2-pyridylaminosulfonyl group.

Examples of an acyl group include: an acetyl group, an ethylcarbonyl group, a propylcarbonyl group, a pentylcarbonyl group, a cyclohexylcarbonyl group, an octylcarbonyl group, a 2-ethylhexylcarbonyl group, a dodecylcarbonyl group, a phenylcarbonyl group, a naphthylcarbonyl group and a pyridylcarbonyl group.

Examples of an acyloxy group include: an acetyloxy group, an ethylcarbonyloxy group, a butylcarbonyloxy group, an octylcarbonyloxy group, a dodecylcarbonyloxy group and a phenylcarbonyloxy group.

Examples of an amido group (a carbonylamino group) include: a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a phenylcarbonylamino group and a naphthylcarbonylamino group.

Examples of a carbamoyl group include: an aminocarbonyl group, a methylaminocarbonyl group, a dimethylaminocarbonyl group, a propylaminocarbonyl group, a pentylaminocarbonyl group, a cyclohexylaminocarbonyl group, an octylaminocarbonyl group, a 2-ethylhexylaminocarbonyl group, a dodecylaminocarbonyl group, a phenylaminocarbonyl group, a naphthylaminocarbonyl group and a 2-pyridylaminocarbonyl group.

Examples of a ureido group include: a methylureido group, an ethylureido group, a pentylureido group, a cyclohexylureido group, an octylureido group, a dodecylureido group, a phenylureido group, a naphthylureido group, and a 2-oyridylaminoureido group.

Examples of a sulfinyl group include: a methylsulfinyl group, an ethylsulfinyl group, a butylsulfinyl group, a cyclohexylsulfinyl group, a 2-ethylhexylsulfinyl group, a dodecylsulfinyl group, a phenylsulfinyl group, a naphthylsulfinyl group and a 2-pyridylsulfinyl group.

Examples of an alkylsulfonyl group: a methylsulfonyl group, an ethylsulfonyl group, a butylsulfonyl group, a cyclohexylsulfonyl group, a 2-ethylhexylsulfonyl group.

Examples of an arylsulfonyl group: a phenylsulfonyl group, a naphthylsulfonyl group and a 2-pyridylsulfonyl group.

Examples of an amino group include: a methylamino group, an ethylamino group, a dimethylamino group, a butylamino group, a cyclopentylamino group, 2-ethylhexylamino group, a dodecylamino group, an anilino group, a naphthylamino group, and a 2-pyridylamino group.

Further groups which can be used as a substituent include: a cyano group; a nitro group; a halogen atom (such as a fluorine atom, a chlorine atom and a bromine atom). These groups may be further substituted with a similar substituent.

Among these groups, preferable groups are: an alkyl group, a trifluoroalkyl group, an aryl group, a heterocyclic group, a hetero aryl group, an alkoxy group, a sulfamoyl group, an ureido group, an amino group, an amide group, an acyl group, an alkoxycarbonyl group, a carbamoyl group, a cyano group and a halogen atom.

More preferable groups are: an alkyl group, a trifluoroalkyl group, a cyano group, an alkoxy group, an amide group, and a halogen atom. And particularly preferable groups are: a trifluoroalkyl group, a cyano group, an alkoxy group.

Metal atom X in Formula (1) represents: Cu, Co, or Ni. Among them, Cu is most preferable.

Representative metal compounds represented by Formula (1) are shown below, however, the metal compounds usable in the present invention are not limited to them. The shown structures are only one of the tautomeric structures that may be taken by the exemplified compounds. The discrimination between the covalent bonds indicated by the solid lines and the coordinate covalent bond indicated by the dotted lines is merely formal and it does not represent an absolute discrimination.

1-1

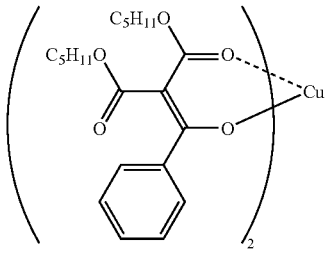

1-2

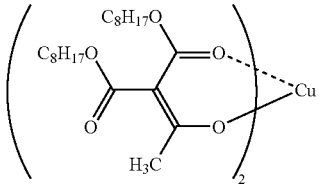

1-3

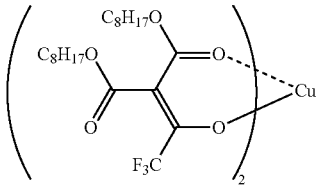

1-4

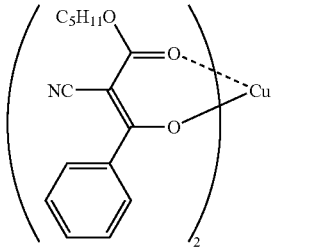

1-5

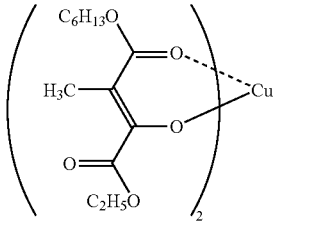

1-6

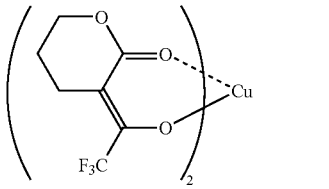

1-7

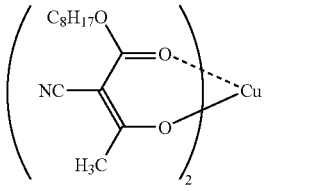

-continued
1-8
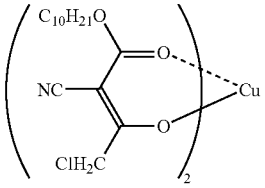
1-9
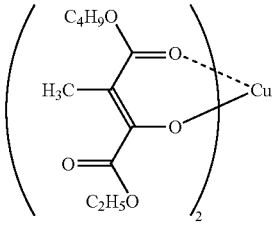
1-10
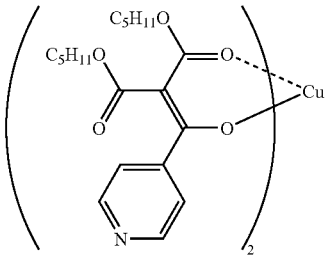
1-11
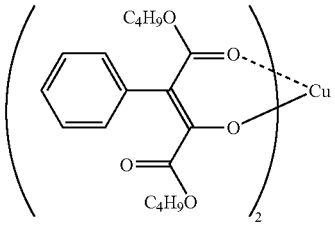
1-12
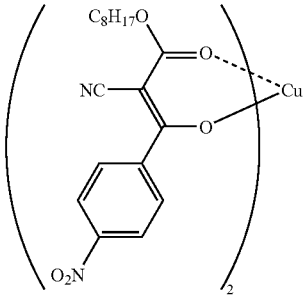
1-13
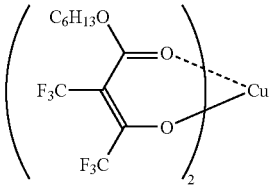
1-14
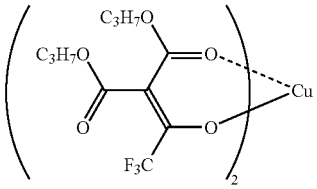
-continued
1-15
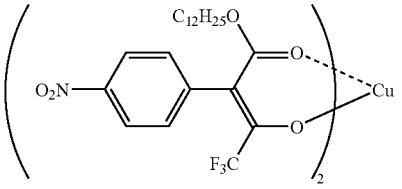
1-16
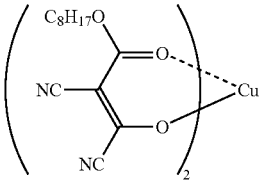
1-17
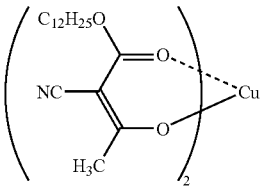
1-18
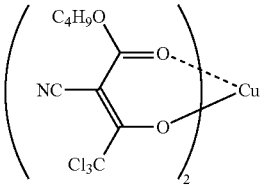
1-19
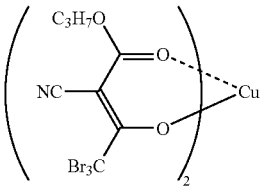
1-20
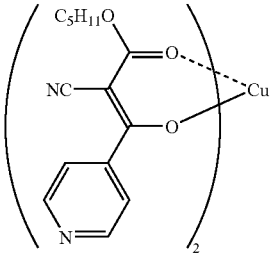
1-21
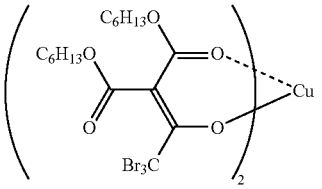

-continued
1-22
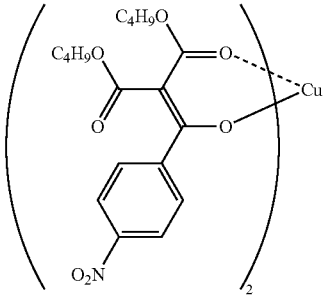
1-23
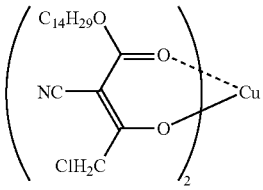
1-24
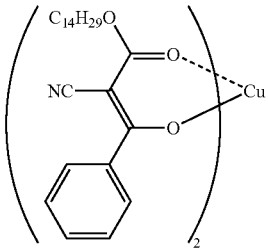
1-25
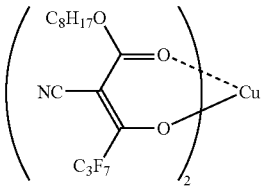
1-26
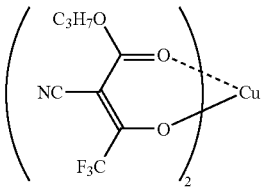
1-27
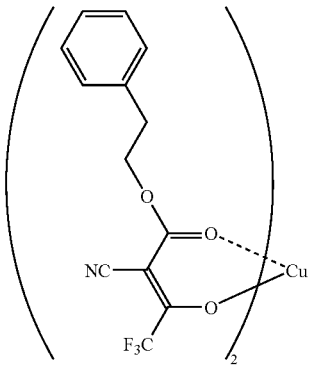
-continued
1-28
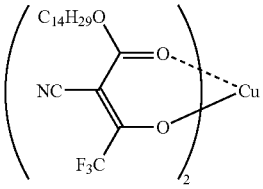
1-29
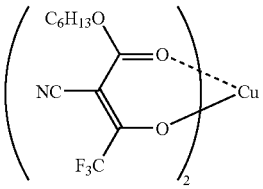
1-30
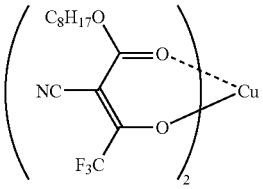
1-31
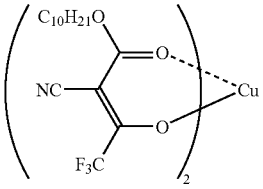
1-32
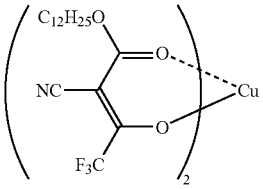
1-33
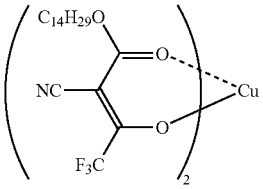
1-34
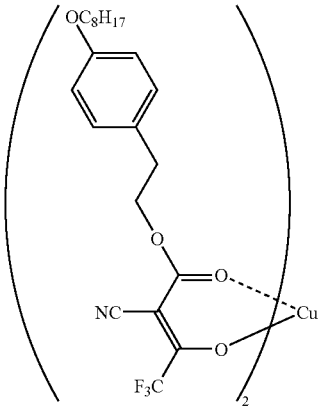

-continued
1-35
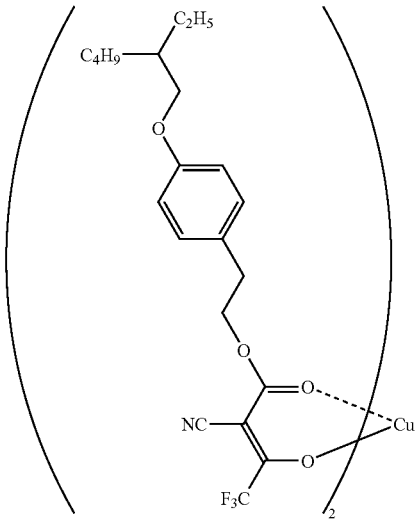
1-36
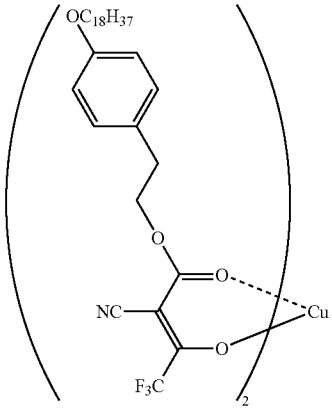
1-37
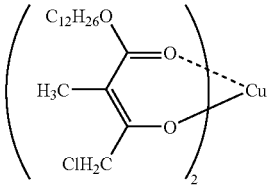
1-38
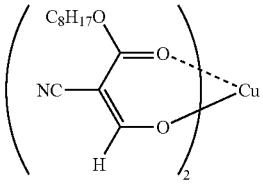
1-39
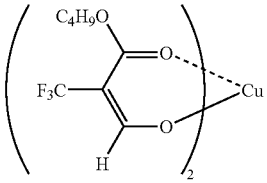
-continued
1-40
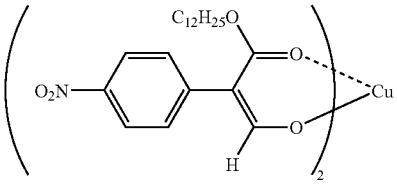
1-41
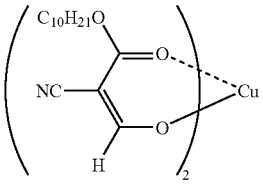
1-42
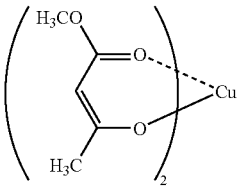
1-43
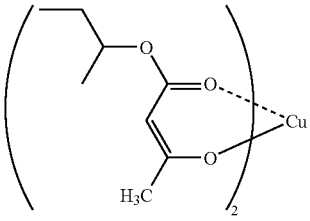
1-44
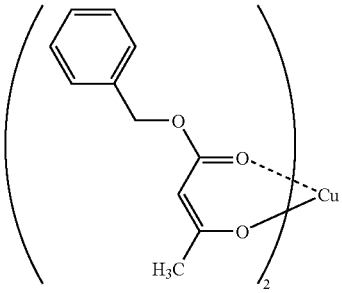
1-45
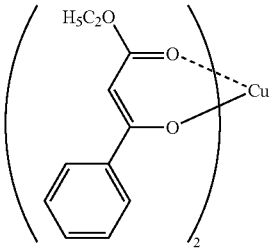
1-46
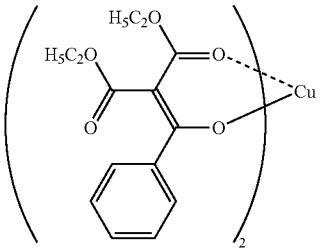

-continued
1-47
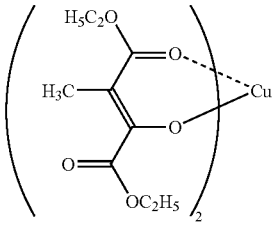
1-48
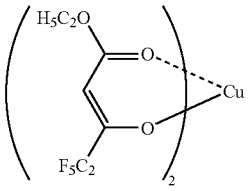
1-49
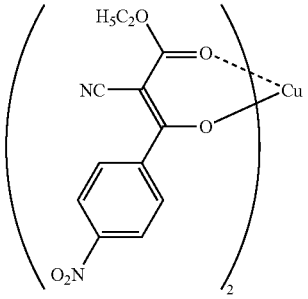
1-50
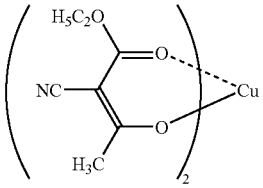
1-51
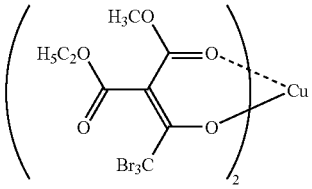
1-52
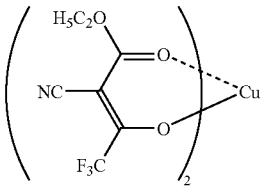
1-53
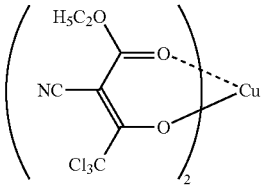
-continued
1-54
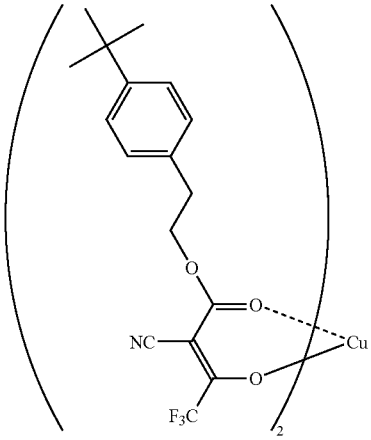
1-55
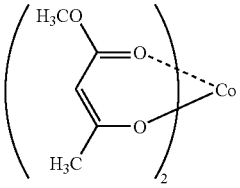
1-56
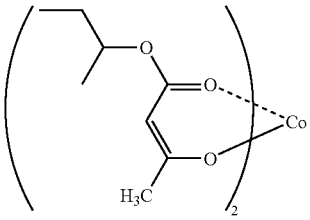
1-57
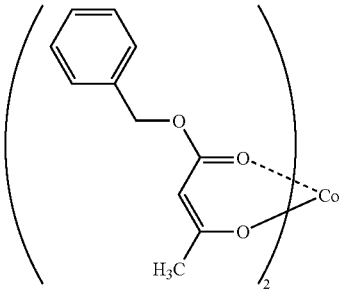
1-58
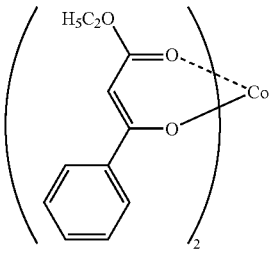

-continued
1-59
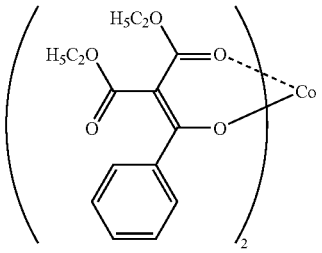
1-60
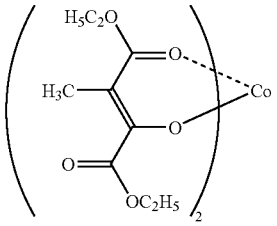
1-61
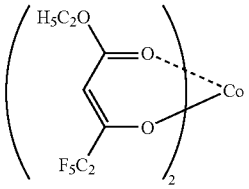
1-62
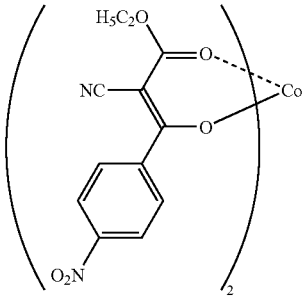
1-63
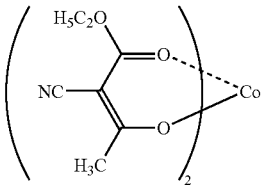
1-64
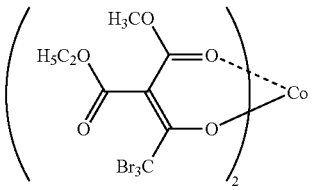
1-65
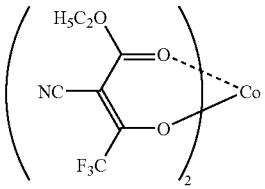
-continued
1-66
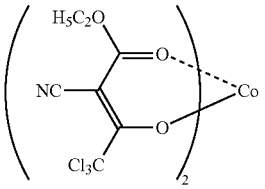
1-67
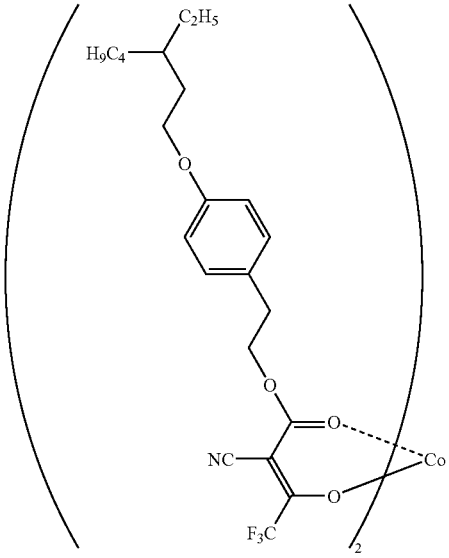
1-68
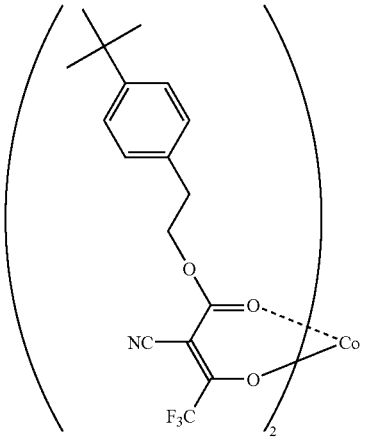
1-69
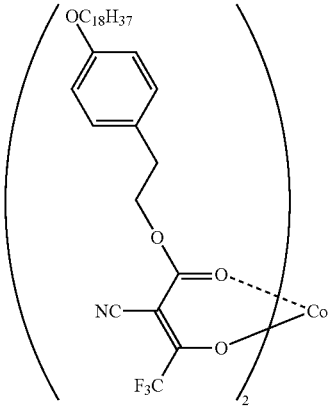

-continued
1-70
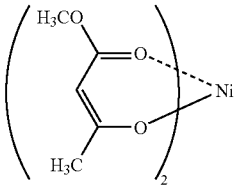
1-71
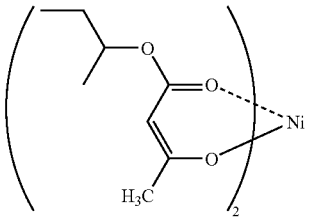
1-72
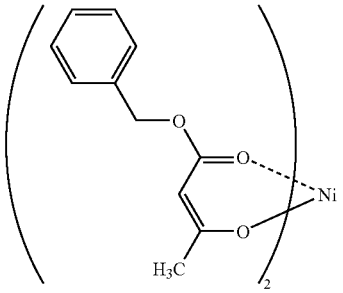
1-73
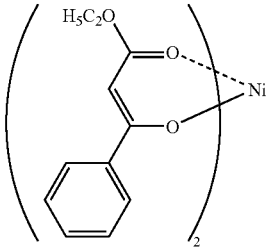
1-74
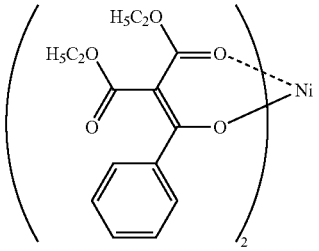
1-75
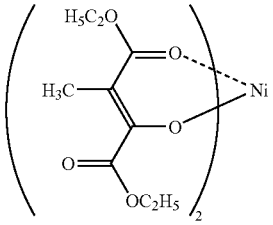
-continued
1-76
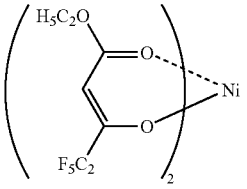
1-77
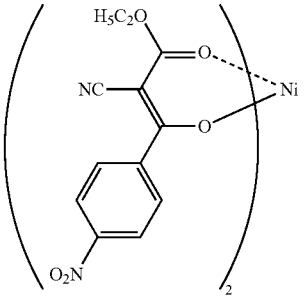
1-78
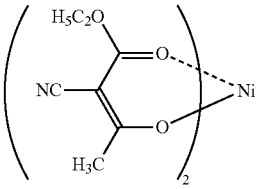
1-79
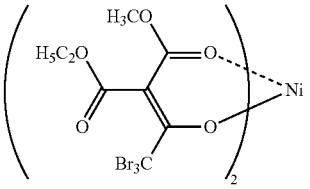
1-80
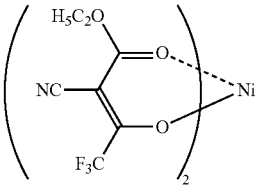
1-81
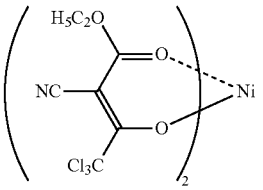

-continued 1-82

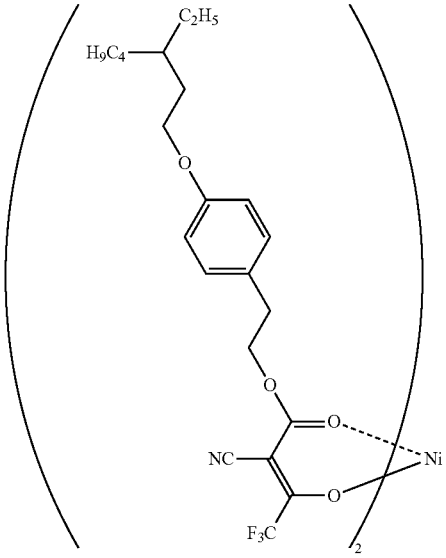

1-83

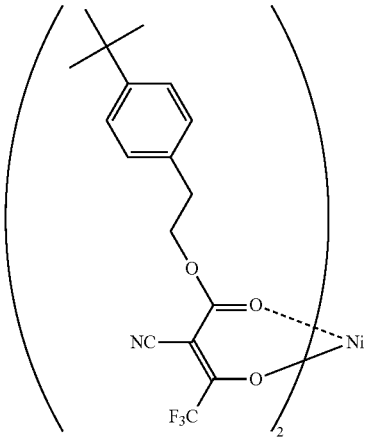

1-84

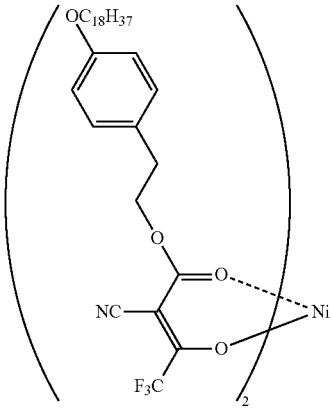

The colorant for a magenta toner of the present invention may be used with other magenta colorant than a compound represented by Formula (X-1). Examples of the colorant which may be used in combination of the aforesaid dye and the aforesaid metal compound include publicly known magenta dyes, and specifically preferable are oil-soluble dyes.

It may possible to jointly use a quinacridone pigment in combination with the aforesaid dye and the aforesaid metal compound. Examples of a quinacridone pigment include: a dimethylquinacridone pigment such as C.I. Pigment Red 122; a dichloroquinacridone pigment such as C.I. Pigment Red 202 and C.I. Pigment Red 209; a non-substituted quinacridone pigment such as C.I. Pigment Red 19; and a mixture or a solid solution of at least two pigments among these exemplified pigments. The pigment may be a powder, a granule or a lump, and further a wet cake or a slurry may be possible. Among the afore-mentioned quinacridone pigments, most preferred quinacridone pigment is C.I. Pigment Red 122.

A silicon phthalocyanine represented by Formula (2) and used for a cyan toner of the present invention will be described.

A cyan toner of the present invention comprises toner particles containing a resin and a colorant. Specifically, the colorant includes a phthalocyanine compound represented by Formula (2). The compound represented by Formula (2) has silicon (Si) as a metal atom located in the center of a phthalocyanine ring. This metal atom is also called as "a central metal atom".

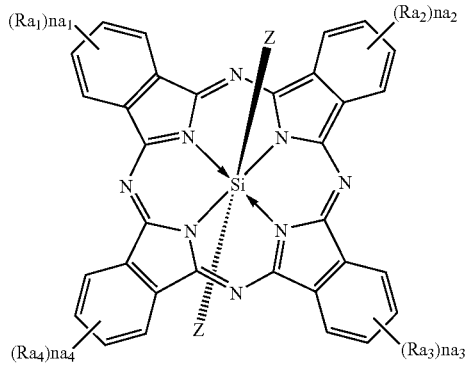

In Formula (2), Z represents a hydroxyl group, a chlorine atom, an aryloxy group of 6 to 18 carbon atoms, an alkoxyl group of 1 to 22 carbon atoms or a group represented by Formula (IV). $R_{a1}$, $R_{a2}$, $R_{a3}$ and $R_{a4}$ each independently represent a substituent. $n_{a1}$, $n_{a2}$, $n_{a3}$ and $n_{a4}$ each independently represent an integer of 0 to 4. The preferred substituents represented by $R_{a1}$, $R_{a2}$, $R_{a3}$ and $R_{a4}$ are an alkyl group (for example, a methyl group, a trifluoromethyl group and an ethyl group), a halogen atom (for example, F, Cl, or Br), and a sulfo group. Specific examples of the preferred substituents represented by any one of $R_{a1}$, $R_{a2}$, $R_{a3}$ and $R_{a4}$ include: a methyl group, a chlorine atom, a trifluoromethyl group and a sulfo group. Preferably $n_{a1}$, $n_{a2}$, $n_{a3}$ and $n_{a4}$ each independently represent an integer of 1 or 2.

Formula (IV)

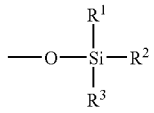

In Formula (IV), $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms. $R^1$, $R^2$ and $R^3$ each may be the same or different. $R^1$, $R^2$ and $R^3$ each represent an alkyl group, an aryl group, an alkoxyl group or an aryloxy group, and the number of carbon atoms of an alkyl group and an alkoxyl group is preferably from 1 to 10, more preferably from 2 to 8.

The cyan toner of the present invention comprises a phthalocyanine compound represented by the aforesaid Formula (2). This compound is also called as a tetraazaporphyrin compound, in which a silicon atom is incorporated as a central metal atom and having axis ligands. Here, an axis ligand is represented by Z in Formula (2).

The cyan toner containing a phthalocyanine compound having axis ligands in the molecule was found to exhibits a superior color reproduction property to the cyan toner containing a phthalocyanine compound having no axis ligand. This is supposed to be resulted from the decreased aggregation or crystallization by the introduction of axis ligands in the molecule. A phthalocyanine compound having axis ligands will be hard to be aggregated or crystallized due to the complex structure compared to a phthalocyanine compound without axis ligand. As a result, the colorant will be kept uniformly dispersed in toner particles or in a formed image after subjected to fixing, this will result in improvement of color reproduction.

A phthalocyanine compound represented by Formula (2) will be incorporated in uniformly dispersed state into toner particles because the aforesaid phthalocyanine compound has a specific structure that is hard to be aggregated or to be crystallized. This is supposed to be the reason of exhibiting an excellent color reproduction property by the toner composed of the compound represented by Formula (2).

Z in Formula (2) is preferably represented by Formula (IV) among all other groups described for Z. In Formula (IV, preferable groups for $R^1$, $R^2$ and $R^3$ are: an alkyl group of 1 to 6 carbon atoms, an aryl group of 6 to 18 carbon atoms, an alkoxyl group of 1 to 6 carbon atoms, provided that $R^1$, $R^2$ and $R^3$ each may be the same or different. Specifically preferred groups for $R^1$, $R^2$ and $R^3$ are: an n-propyl group, an iso-propyl group, an n-butyl group, an iso-butyl group and a t-butyl group. Here again, $R^1$, $R^2$ and $R^3$ each may be the same or different.

In the present invention, the afore-mentioned phthalocyanine compound may be used solely or, two or more phthalocyanine compounds may be jointly used according to need. The amount of the aforesaid phthalocyanine compound is from 1 to 30 weight % based on the total weight of the toner, and preferably from 2 to 20 weight %. As the aforesaid phthalocyanine compound is expected to exhibit a high extinction coefficient, the effects of the present invention will be obtained with a small amount of the addition of the compound.

Examples of a tetraazaporphyrin compound, that is, a phthalocyanine compound having axis ligands, represented by Formula (2) will be shown in Table 1. The compounds represented by Formula (2) which can be sued in the present invention are not to these compounds listed in Table 1.

TABLE 1

| Compound No. | Z | Substituent on benzene rings |
|---|---|---|
| I-1 | —O—$Si(CH_2CH_3)_3$ | |
| I-2 | —OH | |
| I-3 | —O—$Si(CH_2CH_2CH_3)_3$ | |
| I-4 | —O—$Si(CH_3)_3$ | |
| I-5 | —O—$Si(CH(CH_3)_2)_3$ | |
| I-6 | —Cl | |

TABLE 1-continued

| Compound No. | Z | Substituent on benzene rings |
|---|---|---|
| I-7 | —O—$Si(CH_2CH_2CH_2CH_2CH_2CH_2CH_2CH_3)(CH_3)_2$ | |
| I-8 | —O—$Si(t\text{-}C_4H_9)_3$ | |
| I-9 | —O—$Si(CH_2CH_3)_3$ | Monochloro atom |
| I-10 | —O—$Si(CH_2CH_3)_3$ | Dichloro atoms |
| I-11 | —O—$Si(CH_2CH_3)_3$ | Trifluoromethyl group |
| I-12 | —O—$Si(C_{11}H_{23})(CH_3)_2$ | |
| I-13 | —O—$Si(C_{22}H_{45})(CH_2CH_3)(CH_3)$ | |
| I-14 | —O—$Si(CH_2CH_3)(CH_3)(C_6H_5)$ | |
| I-15 | —O—$Si(CH_2CH_3)(CH_3)(C_{18}H_{11})$ | |
| I-16 | —O—$Si(OCH_3)(OC_{22}H_{45})CH_3$ | |
| I-17 | —O—$Si(OC_2H_5)_2(OC_{10}H_{21})$ | |
| I-18 | —O—$CH_3$ | |
| I-19 | —O—$CH_2CH_3$ | |
| I-20 | —O—$CH_2(CH_2)_6CH_3$ | |
| I-21 | —O—$C_{11}H_{23}$ | |
| I-22 | —O—$C_{22}H_{25}$ | |
| I-23 | —O—$C_6H_5$(Phenoxy group) | |
| I-24 | —O—$C_{10}H_7$(Naphthoxy group) | |
| I-25 | —O—$C_{14}H_9$(Antholyloxy group) | |
| I-26 | —O—$C_{16}H_9$(Pyrenyloxyl group) | |
| I-27 | —O—$C_{18}H_{11}$ | |

The chemical structures of I-9, I-10 and I-11 are as follows.

I-9

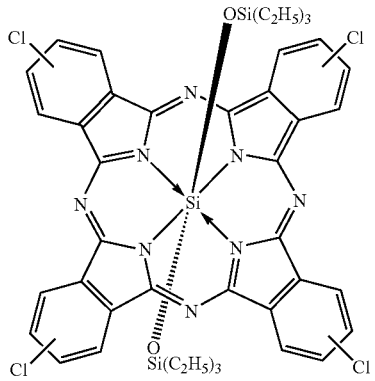

I-10

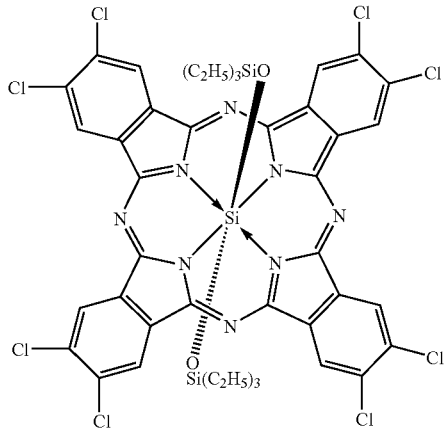

-continued

I-11

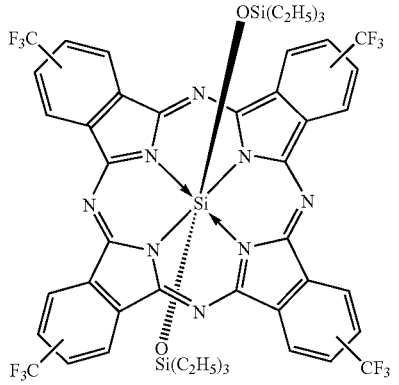

The colorant used for a yellow toner of the present invention will be described.

The yellow toner comprises at least one pigment selected from the group consisting of C.I. Pigment Yellow 74, C.I. Pigment Yellow 139, C.I. Pigment Yellow 155, C.I. Pigment Yellow 180 and C.I. Pigment Yellow 185. In the present invention, the aforesaid yellow pigment may be used solely or may be jointly used with another yellow pigment in the toner. In that case, plural yellow pigments are preferable to be selected from the afore-mentioned group.

In the present invention, it has been achieved to obtain a color image having an expanded color region by using a yellow pigment selected from the aforesaid group compared with conventionally used yellow pigment. The yellow toner incorporating one of the aforesaid yellow pigments can expand the color regions which are overlapped with the color regions covered with a magenta toner or a cyan toner of the present invention. Specifically, it was found that color regions of a second color can be remarkably improved by the set of color toner of the present invention.

The physical properties of the toner according to the present invention will be described.

The toner particles in the toner of the present invention preferably have a volume based median diameter ($D50_v$) from 3 to 8 μm. The volume based median diameter ($D50_v$) of the toner particles of the present invention can be measured and determined employing a size distribution measurement instrument, "COULTER MULTISIZER 3" (produced by Beckman-Coulter Co.) connected with a computer system (produced by Beckman-Coulter Co.) for data processing.

Measurement procedures are as follows. After allowing to soak 0.02 g of toner with 20 ml of a surface active agent solution (for example, a surface active agent solution, aimed at dispersing the toner), which is prepared by diluting a neutral detergent incorporating surface active agent components by a factor of 10), the mixture is subjected to microwave dispersion for one minute, whereby a toner dispersion is prepared. The resulting toner dispersion is injected into a beaker carrying ISOTON II (produced by Beckman-Coulter Co.) in the sample stand until reaching a measurement concentration of 8% by weight. By controlling the concentration to this range, a high reproducible measurement value can be obtained. And measurement is carried out while setting the count of the instrument at 2,500 and the employed aperture diameter of 50 μm. The measuring range of 1 to 30 μm is divided into 256 sections and a frequency value in each section is calculated. The volume based median diameter ($D50_v$) is a particle diameter at which 50% of a volume ratio is achieved when each volume is integrated from a large sized particle to a small sized particle.

The toner particles in the toner of the present invention preferably have a coefficient of variation (CV value) of a volume based particle diameter distribution in the range of 5% to 31%, and more preferably from 10% to 25%.

A coefficient of variation (CV value) of a volume based particle diameter distribution is a value obtained from (A) standard deviation in the volume based particle distribution by dividing (B) median diameter ($D50_v$) in the volume based particle distribution (A/B) and then multiplying by 100. This value can be obtained from the following scheme (1). indicates a degree of distribution of a volume based toner particles size and calculated by the following Equation (1). When the CV value is small, it means that the particle diameter distribution is narrow, hence, the size of the toner particles is uniform.

CV value (%) of a volume based particle diameter distribution=((standard deviation in the volume based particle distribution)/(median diameter ($D50_v$) in the volume based particle distribution))×100. Equation (1):

By controlling the CV value within the range as described above, the toner particles become uniform in volume size. The difference in melting property of the toner particles can be minimized. As a consequence, a toner image can be uniformly melted and adhered. It is possible to reliably reproduce a vivid toner image having a high saturation with the toner composed of a combination of the aforementioned dye, metal compound and pigment of the present invention.

The toner of the present invention contains preferably toner particles having an average circularity defined by the following Equation (2) of 0.930 to 1.000, and more preferably, of 0.950 to 0.995 from the viewpoint of increasing transferring efficiency.

Average circularity=(circumferential length of a circle having the same projective area as that of a particle image)/(circumferential length of the projective particle image) Equation (2):

The toner particles in the toner of the present invention have preferably a softening point ($T_{sp}$) of from 70 to 120° C., and more preferably from 70 to 110° C.

By setting the softening point to be within the above-described range, deterioration which may be induced by the heat applied during fixing can be decreased. As a consequence, an image can be formed without imposing undue thermal stress to the components of the aforementioned dye, metal compound and pigment. As a result, a vivid color image having a wide and stable color reproduction property can be reliably produced.

The softening point of a toner can be controlled by the following methods, singly or in combination:

(1) the kind or the composition of monomer used for resin formation is adjusted;

(2) the molecular weight of a resin is controlled by the kind or the amount of a chain-transfer agent; and (3) the kind or amount of a wax is controlled.

The softening point can be controlled by appropriately combining the methods (1) to (3).

The softening point of a toner may be measured by using, for example, Flow Tester CFT-500 (produced by Shimazu Seisakusho Co., Ltd.). Specifically, a sample which is molded to a 10 mm high column, is compressed by a plunger at a load of $1.96\times10^6$ Pa with heating at a temperature rising rate of 6° C./min and extruded from a long nozzle having a diamante of 1 mm and a length of 1 mm, whereby, a curve (softening flow curve) between plunger-drop and temperature is drawn. The temperature at which flowing-out is initiated is defined as the fusion-initiation temperature and the temperature corresponding to 5 mm drop is defined as the softening temperature.

Next, there will be described resin and wax constituting the toner of the invention, with reference to examples.

Resins usable for the toner of the invention are not specifically limited but are typically polymers formed by polymerization of polymerizable monomers which are called vinyl monomers. A polymer constituting a resin usable in the invention is constituted of a polymer obtained by polymerization of at least one polymerizable monomer, which is a polymer prepared by using vinyl monomers singly or in combination.

Specific examples of a polymerizable vinyl monomer are below:

(1) styrene or styrene derivatives:
  styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, and p-n-dodecylstyrene;
(2) methacrylic acid ester derivatives:
  methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;
(3) acrylic acid ester derivatives:
  methyl acrylate, ethyl acrylate, iso-propyl acrylate, n-butyl v, t-butyl acrylate, iso-butyl acrylate, n-octyl acrylate, 2-ethylhexyl acrylate, stearyl acrylate, lauryl acrylate and phenyl acrylate;
(4) olefins:
  ethylene, propylene and isobutylene;
(5) vinyl esters:
  vinyl propionate, vinyl acetate and vinyl benzoate;
(6) vinyl ethers:
  vinyl methyl ether and vinyl ethyl ether;
(7) vinyl ketones:
  vinyl methyl ketone, vinyl ethyl ketone and vinyl hexyl ketone;
(8) N-vinyl compounds:
  N-vinyl carbazole, N-vinyl indole and N-vinyl pyrrolidone;
(9) others:
  vinyl compounds such as vinylnaphthalene and vinylpyridine; acrylic acid or methacrylic acid derivatives such as acrylonitrile, methacrylonitrile and acrylamide.

There may also usable polymerizable monomers containing an ionic dissociative group, as a vinyl monomer, and including, for example, those having a side chain containing a functional group such as a carboxyl group, a sulfonic acid group or a phosphoric acid group. The dye of the present invention has a weak alkaline property as mentioned above, as a result, combining with the aforementioned monomer is preferable because it will improve the degree of dispersion of the dye in the resin. The followings are specific examples of a vinyl monomer containing an ionic dissociative group.

Specific examples are as follows:

(1) monomers containing a carboxyl group: acrylic acid, methacrylic acid, maleic acid, itaconic acid, cinnamic acid, fumaric acid, monoalkyl maleate, monoalkyl itaconate;
(2) monomers containing a sulfonic acid group: styrenesulfonic acid, allylsulfosuccinic acid, 2-acrylamido-2-methylpropanesulfonic acid; and
(3) monomers containing a phosphoric acid group: acid phosphooxyethyl methacrylate.

Further, a cross-linked resin can be obtained using polyfunctional vinyl compounds. Examples of such poly-functional vinyl compounds are shown below.

Examples of a poly-functional vinyl compound include: divinylbenzene, ethylene glycol dimethacrylate, ethylene glycol diacrylate, triethylene glycol dimethacrylate, triethylene glycol diacrylate, neopentylglycol dimethacrylate and neopentylglycol diacrylate.

The toner of the present invention may contain a wax with a resin and the aforementioned dye. Examples of a was include:

(1) polyolefin wax such as polyethylene wax and polypropylene wax;
(2) long chain hydrocarbon wax such as paraffin wax and sasol wax and microcrystalline wax;
(3) dialkyl ketone type wax such as distearyl ketone;
(4) ester type wax such as carnauba wax, montan wax, trimethylolpropane tribehenate, pentaerythritol tetramyristate, pentaerythritol tetrabehenate, pentaerythritol diacetate dibehenate, behenyl behanate, glycerin tribehenate, 1,18-octadecanediol distearate, trimellitic acid tristearate, and distearyl meleate; and
(5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. In the present invention, one of the waxes of the above-described waxes may be used singly or may be used in combination with other waxes. Among the above-described waxes, preferable waxes are microcrystalline wax and behenyl behanate, and the combination of these two waxes.

By using a wax having a melting point falling within the foregoing range, heat stability of toners can be ensured. And stable toner image formation can be achieved without causing cold offsetting even when the image is fixed at a relatively low temperature. The wax content of the toner is preferably in the range of 1% to 30% by mass, and more preferably 5% to 20%. By setting the added amount of the wax within the above-described range, undisturbed separation property of the paper in fixing step can be achieved, and further, the transparency of the toner image can be maintained.

Further, a well-known charge controlling agent can also be added to the toner of the present invention. A charge controlling agent is not particularly limited. A colorless, white, or light colored charge controlling agent which does not have an adverse effect on the color tone of a toner and on light transmittance can be used as a negative charge controlling agent. Examples of a negative charge controlling agent are as follows: a metal complex of a salicylic acid derivative; a calixarene compound; an organic boron compound; and a fluorine containing quaternary ammonium salt compound. The amount of addition of these charge controlling agent is preferably 0.1 to 10 mass parts to 100 mass parts of a binder resin, and more preferably 0.5 to 5.0 mass parts.

The above-mentioned salicylic acid metal complex which can be used in the present invention is disclosed, for example, in JP-A Nos. 53-127726 and 62-145255. As a calixarene compound which can be used is, for example, disclosed in JP-A No. 2-201378. As an organic boron compound which can be used is, for example, disclosed in JP-A Nos. 2-221967.

As a fluorine containing quaternary ammonium salt compound which can be used is, for example, disclosed in 3-1162.

An image stabilizer can also be added in order to raise a image lasting quality. Examples of an image stabilizer include: the compounds disclosed in JP-A No. 8-29934; and an a phenol compound, an amine compound, a sulfur compound, a phosphor compound available in the market as an image stabilizer. In addition, an ultraviolet absorption agent can also be added for the same purpose, and a well-known organic ultraviolet absorption agent and an inorganic system ultraviolet absorption agent can be added.

Specific examples of an organic ultraviolet absorption agent are as follows, (1) Benzotriazole compound: 2-(2'-hydroxy-5'-t-butylphenyl)benzotriazole, 2-(2'-hydroxy-3',5'-di-t-butylphenyl) benzotriazole;
(2) Benzophenone compound: 2-hydroxy-4-methoxybenzophenone and 2-hydroxy-4-n-octyloxybenzophenone;
(3) Phenyl salicylate compound: phenyl salicylate, 4-t-butylphenyl salicylate; and
(4) Hydroxybenzoate compound: 2,5-t-butyl-4-hydroxybenzoic acid n-hexadecyl ester, 2,4-di-t-butylphenyl-3',5'-di-t-butyl-4'-hydroxybenzoate.

Specific examples of an inorganic ultraviolet absorption agent are as follows: titanium oxide, zinc oxide, cerium oxide, iron oxide and barium sulfate.

Among an organic ultraviolet absorption agent and an inorganic ultraviolet absorption agent, an organic system absorption agent is more preferable.

An ultraviolet absorption agent has preferably a 50% transmittance in the range of 350-420 nm, and more preferably in 360-400 nm. By making a 50% transmittance wavelength into the above-mentioned range, the shielding ability for an ultraviolet light can be exhibited and there is no influence of coloring by having added the ultraviolet absorption agent. Although the amount of addition of an ultraviolet absorption agent is not particularly limited, a preferably amount of addition is 10-200 mass % to coloring matter, and more preferably it is 50-150 mass %.

Furthermore, from a viewpoint of giving fluidity of a toner, or improving cleaning property, the toner of the present invention can be added and mixed a well-known external additive in the toner. The kinds of these external additives is not particularly limited, and various inorganic particulates, organic particulates, and lubricants can be used.

Examples of an inorganic particulates are: inorganic oxide particles such as silica, alumina, and titania; titanic acid compound particles such as strontium titanate, barium titanate and calcium titanate, a number average primary particle size of 5 to 300 nm of these particles are preferably 5-300 nm. These external additives may be subjected to a hydrophobic treatment using, for example, a silane coupling agent, a titanium coupling agent, a higher fatty acid, or silicone oil in order to improve environmental stability or heat-resistance during storage.

Spherical organic microparticles having a number-average primary particle size of 10 to 2000 nm are usable as organic microparticles. Specifically, there is usable styrene or methyl methacrylate homopolymer or their copolymers. Further, as a lubricant to be incorporated in the toner is aluminium stearate and zinc stearate.

Such an external additive may be added solely or in combination with two or more of other additives. Such an external additive is incorporated preferably in an amount of 0.05 to 5 weight % based on the total weight of the toner, and more preferably in an amount of 0.1 to 3 weight %.

(Manufacturing Method of Toner)

Methods to manufacture the toner of the present invention will be described. The methods are not particularly limited and listed may be a pulverization method, a suspension polymerization method, an mini-emulsion polymerization aggregation method, an emulsion polymerization aggregation method, a dissolution suspension method, and a polyester molecule elongation method, as well as other conventional methods. Of these, it is preferable to prepare the toner via the mini-emulsion polymerization aggregation method.

In a mini-emulsion polymerization aggregation method, a polymerizable monomer solution in which waxes are dissolved is placed into an aqueous medium in which surface active agents are dissolved to reach at most the critical micelle concentration, and by utilizing mechanical energy, a dispersion, in which 10-1,000 nm oil droplets are formed, is prepared. Water-soluble radical polymerization initiators are added to the resulting dispersion followed by polymerization, whereby binder resin particles are formed. Further, by aggregating binder resin particles while fusing particles, toner particles are prepared.

Reasons why the mini-emulsion polymerization aggregation method is preferred are that since polymerization is carried out within each oil droplet, it is possible to form a state in which wax particles are assuredly included via the binder resins within the toner particle, and as a result, vaporization components are not generated until heating via a fixing apparatus, and wax performance is not deteriorated.

In addition, in the mini-emulsion polymerization aggregation method, instead of the addition of the aforesaid water-soluble radical polymerization initiators, or together with the water-soluble radical polymerization initiators, it is also possible to achieve polymerization by adding oil-soluble radical polymerization initiators into the aforesaid monomer solution.

As the toner preparation method, according to the present invention, during formation of resin particles via the mini-emulsion polymerization aggregation method, it is possible to form resin particles having a structure of at least two layers composed of binder resins which differ in composition. In this case, polymerization initiators and polymerizable monomers are added to the first resin particle dispersion which is prepared via a conventional mini-emulsion polymerization process (being a first step polymerization), and the resulting system then undergoes polymerization (being the second step polymerization). In the above manner, it is possible to form resin particles exhibiting a double layer structure. By repeating the above second step polymerization, it is possible to form resin particles, each having a multilayer structure.

One example of a method for producing a toner employing the mini-emulsion polymerization aggregation method will now be specifically described. The method includes the following procedures.

(1) a dissolving and dispersing process which prepares a polymerizable monomer solution by dissolving or dispersing, toner particle constituting materials such as a wax and a charge controlling agent according to need, in a polymerizable monomer used for a binding resin;
(2) a dispersed solution preparation process in which the aforesaid metal compound, dye and pigment each are dispersed in an aqueous media to obtain: a metal compound particle dispersion solution, and a dye particle dispersion solution and a pigment particle dispersion solution.
(3) a polymerization process in which oil droplets of the aforesaid polymerizable monomer solution are formed in an aqueous medium and then a binder resin particle dispersion is prepared using a mini-emulsion method;

(4) an aggregating and fusing process in which aggregated particles are formed from the aforesaid binder resin particles, dye particles and pigment particles via aggregation, and fusion in an aqueous medium;

(5) a ripening process in which a dispersion of the colored particles is prepared by ripening aggregated particle via thermal energy to regulate their shape;

(6) a cooling process in which the dispersion of colored particles are cooled;

(7) a filtering and washing process in which the aforesaid colored particles are subjected to solid-liquid separation from the cooled colored particle dispersion, and surface active agents and the like are removed from the aforesaid colored particles; and (8) a drying process which dries the colored particles which have been washed.

(9) an external additive treatment process in which an external additive is added to the dried toner particles.

Each of the above processes will now be described below.

(1) Dissolving/Dispersion Process

This process is a process to dissolve or disperse toner particle constituting materials such as a wax and colorants in a polymerizable monomer to prepare a polymerizable monomer solution. An oil-soluble polymerization initiator and/or other oil-soluble components, which will be described later, may be added to the polymerizable monomer solution.

(2) Dispersion Preparation Process

This dispersion preparation process is one in which the aforesaid metal compounds, the dyes and the pigments are dispersed into a respective aqueous medium, and each of the metal compound dispersion, the dye particle dispersion, and the colorant particle dispersion is prepared.

It is possible to prepare these colorant particle dispersions by dispersing colorants into an aqueous medium. The dispersion process of colorant particles is carried out in such a state that the concentration of surface active agents exceeds the critical micelle concentration (CMC) in water. Homogenizers employed for the dispersion process of colorant particles are not particularly limited and preferably employed are ultrasonic homogenizers, mechanical homogenizers, and pressure homogenizers such as a Manton-Gaulin homogenizer or pressure system homogenizer, as well as medium type homogenizers such as a sand grinder, a Getzmann mill, or a diamond fine mill.

It is possible to employ colorant particles which have undergone surface property modification. In practice, colorant particles are dispersed into solvents and surface property modifying agents are then added to the above dispersion. Subsequently, by increasing the temperature of the above system, the targeted reaction is carried out. After completion of the reaction, the colorant particles are collected via filtration. After repeated washing with the same solvents, drying is carried out, whereby it is possible to prepare minute colorant particles which have been treated with the surface property modifying agents.

(3) Polymerization Process

The above process is one to form binder resin particles incorporating waxes and binder resins. In the polymerization process, for example, the aforesaid polymerizable monomer solution is added to an aqueous medium incorporating surface active agents at a concentration of, at most, the critical micelle concentration, and oil droplets are formed via application of mechanical energy. Subsequently, by adding water-soluble radical polymerization initiators, a polymerization reaction is carried out in the aforesaid oil droplet. Further, when multilayer structure resin particles are formed, resin particles, which are employed as a nucleus particle in the aqueous medium, may be added.

The binder resin particles formed in the polymerization process may be or may be not colored. Colored binder resin particles are formed by polymerizing a monomer composition incorporating colorants. Further, when the binder resin particles, which are not colored, are formed, a colorant particle dispersion is added into the binder resin particle dispersion during the aggregation process, described below, followed by aggregation of the binder resin particles with the colorant particles, whereby it is possible to form toner particles.

"Aqueous medium", as described herein, refers to a medium which is composed of water as a major component (at least 50% by weight). Namely, it refers to a dispersion medium composed of 50-100% by weight of water and 0-50% by weight of water-soluble organic solvents. Examples of water-soluble organic solvents, which are components other than water, include methanol, ethanol, isopropanol, butanol, acetone, methyl ethyl ketone, and tetrahydrofuran. Of these, specifically preferred are alcohol based organic solvents such as methanol, ethanol, isopropanol, and butanol, which do not dissolve the resins.

Further, methods to disperse a polymerizable monomer solution into an aqueous medium are not particularly limited, but a method is preferred in which dispersion is carried out via application of mechanical energy. Homogenizers in which oil droplet dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably 10-1,000 nm, but is more preferably 20-300 nm.

(4) Aggregation and Fusion Process

An aggregation and fusion process is one in which the binder resin particles, formed via the aforesaid polymerization process, are aggregated and fused in an aqueous medium. During the aggregation and fusion process, if the aforesaid binder resin particles are not colored, a colorant particle dispersion is added into the binder resin particle dispersion, followed by aggregation and fusion of the binder resin particles and the colorant particles. During the intermediate step of the above aggregation and fusion process, it is possible to carry out aggregation by the addition of binder resin particles which differ in the resin composition.

Further, in the aforesaid aggregation and fusion process, it is possible to carry out aggregation and fusion by the addition of internal additive particles such as charge control agents together with binder resin particles and colorant particles.

A preferred aggregation and fusion method is that aggregating agents composed of alkaline metal salts and alkaline earth metal salts are added, in an amount to reach at least the critical aggregation concentration, to an aqueous medium in which binder resin particles and colorant particles exist, whereby these particles are aggregated. Subsequently, heating is carried out to at least the glass transition temperature of the binder resin particles, as well as to at least the melt peak temperature of wax, whereby aggregation and fusion are simultaneously carried out.

During the above aggregation and fusion process, it is required to quickly increase the temperature by heating, and the temperature increasing rate is preferably at least 1° C./minute. The upper limit of the temperature increasing rate is not particularly limited. However, since coarse particles are generated via the progress of quick aggregation and fusion, to retard the above, at most 15° C./minute is preferred.

Further, it is critical that after the temperature of the binder resin particle and colorant particle dispersion reaches at most the glass transition and also at most the melt peak temperature of wax, coagulation and fusion are allowed to continue by maintaining the temperature of the aforesaid dispersion for a predetermined duration. As noted above, by maintaining the temperature of the dispersion for the predetermined duration, growth (coagulation of binder resin particles and colorant particles) of toner particles and fusion (elimination of the interface between the particles) are effectively carried out, whereby it is possible to enhance endurance of the finally prepared toner.

(5) Ripening Process

The above ripening process is one in which, in practice, a system incorporating aggregated particles is stirred while heated, and the shape of aggregated particles is regulated by controlling the heating temperature, the stirring rate, and the heating temperature to reach the targeted average circularity, whereby toner particles having the targeted shape are prepared. In the above ripening process, it is preferable to carry out shape control of toner particles via thermal energy (heating).

Further, during the aforesaid ripening process, a binder resin particle dispersion is further added to the aforesaid toner particle dispersion so that the binder resin particles are adhered onto the surface of the toner particle to result in fusion and toner particles designated, as a so-called core-shell structure, may be formed. In this case, it is preferable that the glass transition point temperature of the binder resin particles forming the shell is regulated to be 20° C. higher than that of the binder resin particles which constitute the core.

(6) Cooling Process

This process is a process of subjecting the dispersion of the toner particles to the cooling treatment. The condition of the cooling treatment is to cool is preferably at a cooling rate of 1-20° C./min. The method of the cooling treatment, although it is not specifically limited, may include a method of cooling by introducing a cooling medium from outside of a reaction container and a method of cooling by directly charging cool water into the reaction system.

(7) Solid-Liquid Separation and Cleaning Process

In the solid-liquid separation and cleaning process, the following treatments are applied: a solid-liquid separation treatment of subjecting the toner particles to solid-liquid separation from the dispersion of the toner particles having been cooled down to a predetermined temperature in the above process; and a cleaning treatment of removing deposits such as the surfactant and the salting-out agent from a toner cake (an aggregation substance with a cake-shape) having been subjected to solid-liquid separation.

In the cleaning treatment, the washing with water is repeated to and checked the electric conductivity of the filtrated water to become 10 μS/cm. In the solid-liquid separation treatment, the known methods such as the centrifugal separation method, vacuum filtration method using Nutsche, and the filter method using a filter press are employed.

(8) Drying Process

This process is a process of subjecting the toner cake having been subjected to the cleaning treatment to the dry treatment to obtain dried colored particles. Listed as the dryer used in this process may be, for example, a spray dryer, a vacuum-freeze dryer, and a decompression dryer, and it may be used a stationary rack-dryer, a movable rack-dryer, a fluidized dryer, a rolling dryer, an agitation dryer and other dryers. The water content of the dried colored particle is preferably 5% by weight or less, more preferably 2% by weight or less. Incidentally, when the toner particles having been subjected to the dry treatment are agglomerated with a weak intermolecular force among the particles, the agglomeration may be subjected to a powder treatment. Herein, mechanical type of powder machines such as a jet-mill, HENSCHEL MIXER, a coffee mill, a food processor may be used as the powder treatment machine.

(9) External Additive Treatment Process

This process is a process of manufacturing the toner by mixing an external additive in the dried toner particles according to the necessity. As the mixer for the external additive, mechanical type of mixers such as a HENSCHEL MIXER and a coffee mill may be used.

By following the above-described processes, the color toners of the present invention can be produced with the mini-emulsion polymerization aggregation method.

Next, a surface active agent, a polymerization initiator, a chain transfer agent and an aggregation agent used in the preparation of the toner with the mini-emulsion polymerization aggregation method will be described.

(Surface Active Agents)

When the toner according to the present invention is produced via a suspension polymerization method, the aforesaid mini-emulsion polymerization aggregation method, or an emulsion polymerization aggregation method, surface active agents are added into an aqueous medium, whereby binder resins and aggregated particles are prepared. Surface active agents employed in these polymerization methods are not particularly limited, but the ionic surface active agents listed below are preferred:

(1) sulfonic acid salts; sodium dodecylbenznesulfonate and sodium arylalkylpolyether sulfonate
(2) sulfuric acid ester salts; sodium dodecylsulfate, sodium tetradecylsulfate, sodium pentadecylsulfate, and sodium octylsulfate
(3) fatty acid salts; sodium oleate, sodium laurate, sodium caprate, sodium caprylate, sodium caproate, potassium stearate, and calcium oleate.

Further, it is also possible to employ the nonionic surface active agents listed below: namely, polyethylene oxides, polypropylene oxides, combinations of polypropylene oxides and polyethylene oxides, esters of polyethylene glycol with higher fatty acids, alkylphenol polyethylene oxides, esters of higher fatty acid and polyethylene glycol, esters of higher fatty acid and polypropylene oxides, and sorbitan esters.

(Polymerization Initiators)

When the toner according to the present invention is produced via a suspension polymerization method, the aforesaid mini-emulsion polymerization aggregation method, or an emulsion aggregation method, it is possible to form binder resins by polymerizing polymerizable monomers while employing radical polymerization initiators.

When resins are formed via the suspension polymerization method, oil-soluble radical polymerization initiators are employable. Specific examples of the oil-soluble polymerization initiators include:

(1) azo based or diazo based polymerization initiators; 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile
(2) peroxide based polymerization initiators; benzoyl peroxide, methyl ethyl ketone peroxide, diisopropylperoxycarbonate, cumenehydroperoxide, t-butylhydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine, and (3) polymer polymerization initiators having a peroxide on the side chain Further, when binder resins are formed via the mini-emulsion polymerization aggregation method or the emulsion polymerization aggregation method, water-soluble radical polymerization initiators are employable. Examples of water-soluble radical polymerization initiators include persulfate salts such as potassium persulfate or ammonium persulfate, azobisaminodipropane acetic acid salts, azobiscyanovaleric acid and salts thereof, and hydrogen peroxide.

(Chain Transfer Agents)

When the toner according to the present invention is produced via a suspension polymerization method, the aforesaid mini-emulsion polymerization aggregation method, or an emulsion polymerization aggregation method, to regulate the molecular weight of binder resins, prior art chain transfer agents are employable. Specific chain transfer agents include mercaptans such as n-octylmercaptan, n-decylmercaptan, or tert-dodecylmercaptan, as well as n-octyl-3-mercaptopropionic acid esters, terpinolene, carbon tetrabromide, and α-methylstyrene dimers.

(Aggregating Agents)

When the toner according to the present invention is produced via a mini-emulsion polymerization aggregation method or an emulsion polymerization aggregation method, in order to aggregate resin particles, aggregating agents are employed. Examples of aggregating agents include alkaline metals and alkaline earth metals. Alkaline metals to constitute aggregating agents include lithium, potassium, and sodium, while alkaline earth metals to constitute aggregating agents include magnesium, calcium, strontium, and barium. Of these, preferred are potassium, sodium, magnesium, calcium, and barium. As a counter ion (being an anion to constitute a salt) of the aforesaid alkaline metals or alkaline earth metals, listed are a chloride ion, a bromide ion, an iodide ion, a carbonate ion, and a sulfate ion.

When the toner according to the present invention is employed as a developer, it may be used in a single component based developer which employs only the toner according to the present invention, or even in a two component developer composed of a toner and a carrier. Either one of these two enables realization of favorable image formation which exhibits the targeted effects of the present invention. In addition, when employed as a single component based developer, it is possible to employ it as a magnetic single component developer incorporating magnetic metal particles in the toner particles or as a non-magnetic single component developer incorporating no magnetic metal particles in the toner particles.

Carriers, which are employed in the case employed as a two component developer, are not particularly limited, and any prior art carriers are employable. Specifically, preferred are the resin coated carriers which are described in JP-A Nos. 62-39879 and 56-11461.

Resin coated carriers will now be described. The volume based median diameter of carriers is preferably 20-80 μm, but in view of realizing preferred image quality and enhancing filming resistance, is more preferably 25-35 μm. Further, in nucleus particles which constitute the resin coated carrier, it is possible to employ ferrite and magnetite granulation materials, and of these, preferred are ferrites. In view of minimizing carrier adhesion, of those known in the art, as a ferrite composition, preferred are manganese-magnesium-strontium ferrites.

As coating resins which constitute the resin coated carrier, employed are polymer resins in which the polymerizable monomers listed below are individually employed or copolymer resins which are formed by employing at least two types of the polymerizable monomers listed below:

(1) styrenes; styrene and α-methylstyrene
(2) α-methylene fatty acid monocarboxylic acids; methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate,
(3) nitrogen-containing acryls; dimethylaminoethyl methacrylate
(4) vinylpyridines; 2-vinylpyridine and 4-vinylpyridine
(5) vinyl nitrites; acrylonitrile and methacrylonitrile
(6) vinyl ethers; vinyl methyl ether and vinyl isobutyl ether
(7) vinyl ketones; vinyl methyl ketone, vinyl ethyl ketone, and vinyl isopropenyl ketone
(8) olefins; ethylene and propylene
(9) vinyl based fluorine-containing monomers; vinylidene fluoride, tetrafluoroethylene, and hexafluoroethylene Further, the following resins are applicable; namely silicone resins incorporating methylsilicone or methylphenylsilicone, polyester resins incorporating bisphenol or glycol, epoxy resins, polyurethane resins, polyamide resins, cellulose resins, polyether resins, and polycarbonate resins.

It is possible to form coating resins by employing these resins individually or in combinations of at least two types. Of these, in view of humidity dependence during charging, preferred are styrene/cyclohexyl methacrylate copolymer resins (at a copolymerization ratio of 5:5-9:1). From the same point of view, preferred are those in which approximately 50% of perfluoroacrylate is simultaneously employed.

Further, in view of abrasion resistance of resin coating layers, it is possible to add methyl polymethacrylate resin or melamine resin particles at a number average particle diameter of 0.1-0.3 μm. In addition, in view of enhancing development characteristics, it is possible to add carbon black, graphite, titanium oxide, and aluminum oxide to the resin coating layer in an amount of about 5- about 30%.

The coated amount of coating resins is preferably in the range of 0.1-10 parts by weight with respect to 100 parts by weight of nucleus particles, but is more preferably in the range of 0.5-3.0 parts by weight.

Further, it is possible to select an appropriate mixing ratio of a toner and a carrier which constitute a two component developer, depending on the specified target.

An Image forming method, which is carried out employing the toner according to the present invention, will now be described. The electrophotographic system image forming method, which is carried out employing the toner according to the present invention, includes at least the following processes: namely (1) an electrostatic latent image forming process which forms electrostatic latent images on an electrostatic latent image carrier (being a photoreceptor),
(2) a development process which forms toner images by developing electrostatic latent images formed on the electrostatic latent image carrier by employing a developer which is prepared by incorporating the toner according to the present invention,
(3) a transfer process which transfers toner images formed on the electrostatic latent image carrier onto a transfer body such as a sheet, and
(4) a fixing process which fixes the toner images transferred onto the transfer body.

In addition to the aforesaid four processes, other processes may be included. For example, after transferring toner images, it is preferable to include a cleaning process which removes any residual toner on the surface of the electrostatic latent image carrier. Further, during the transfer process, the toner image transfer onto a recording medium, from the electrostatic latent image carrier, may be carried out via an intermediate transfer body.

FIG. 1 illustrates an example of an image forming apparatus in which the toner of the present invention is usable as a two-component developer.

In FIG. 1, 1Y, 1M, 1C and 1K each designate photoreceptors; 4Y, 4M, 4C and 4K each designate a developing means; 5Y, 5M, 5C and 5K each designate primary transfer rollers; 5A designates a secondary transfer roller; 6Y, 6M, 6C and 6K each designate cleaning means; the numeral 7 designates an intermediate transfer unit; the numeral 24 designates a heat roll type fixing device; and the numeral 70 designates an intermediate transfer material.

This image forming apparatus is called a tandem color image forming apparatus, which is, as a main constitution, composed of plural image forming sections 10Y, 10M, 10C and 10B, an intermediate transfer material unit 7 including an endless belt form of a transfer belt, paper feeding and conveying means 22A to 22D to convey recording member P and heated roll-type fixing device 24. Original image reading device SC is disposed in the upper section of image forming apparatus body A.

Image forming section 10Y to form a yellow image contains a drum-form photoreceptor 1Y; electrostatic-charging means 2Y, exposure means 3Y and developing means 4Y which are disposed around the photoreceptor 1Y; primary transfer roller 5Y; and cleaning means 6Y.

Image forming section 10M to form a magenta image as another color contains a drum-form photoreceptor 1M; electrostatic-charging means 2M, exposure means 3M and developing means 4M which are disposed around the photoreceptor 1M; primary transfer roller 5M; and cleaning means 6M.

Image forming section 10C to form a cyan image as another color contains a drum-form photoreceptor 1C; electrostatic-charging means 2Y, exposure means 3C and developing means 4C which are disposed around the photoreceptor 1C; primary transfer roller 5C; and cleaning means 6C.

Further, there are provided an image forming section 10K to form a black image containing a drum-form photoreceptor 1K; electrostatic-charging means 2K, exposure means 3K and developing means 4K which are disposed around the photoreceptor 1K; primary transfer roller 5K; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat roller type fixing device 24, nipped by paper discharge roller 25 and put onto paper discharge tray 26 outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

In the process of image formation, toner images are formed on photoreceptors 1Y, 1M, 1C and 1K, through electrostatic-charging, exposure and development, toner images of the individual colors are superimposed on the endless belt form, intermediate transfer material 70, transferred together onto recording member P and fixed by compression and heating in heat roller type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

Moreover, a full-color image formation method using a non-magnetic mono-component developer can be realized by using, for example, an image forming apparatus in which the afore-mentioned development means for a two-component developer is substituted with a well-known development means for a non-magnetic mono-component developer.

Further, the fixing method that can be used for an image formation method using the toner of the present invention is not particularly limited, and a well-known fixing system can be applied. Examples of a well-known fixing system are: a roller fixing system containing a heat roller and a pressure roller; a fixing system containing a heat roller and a pressure belt: a fixing system containing a heat belt and a pressure roller; a belt fixing system composed of the heat belt and a press belt. Any of these systems may be used. Moreover, as a heating system, well-known heating systems can be used such as a halogen lamp system, and IH fixing system.

Figure 2:
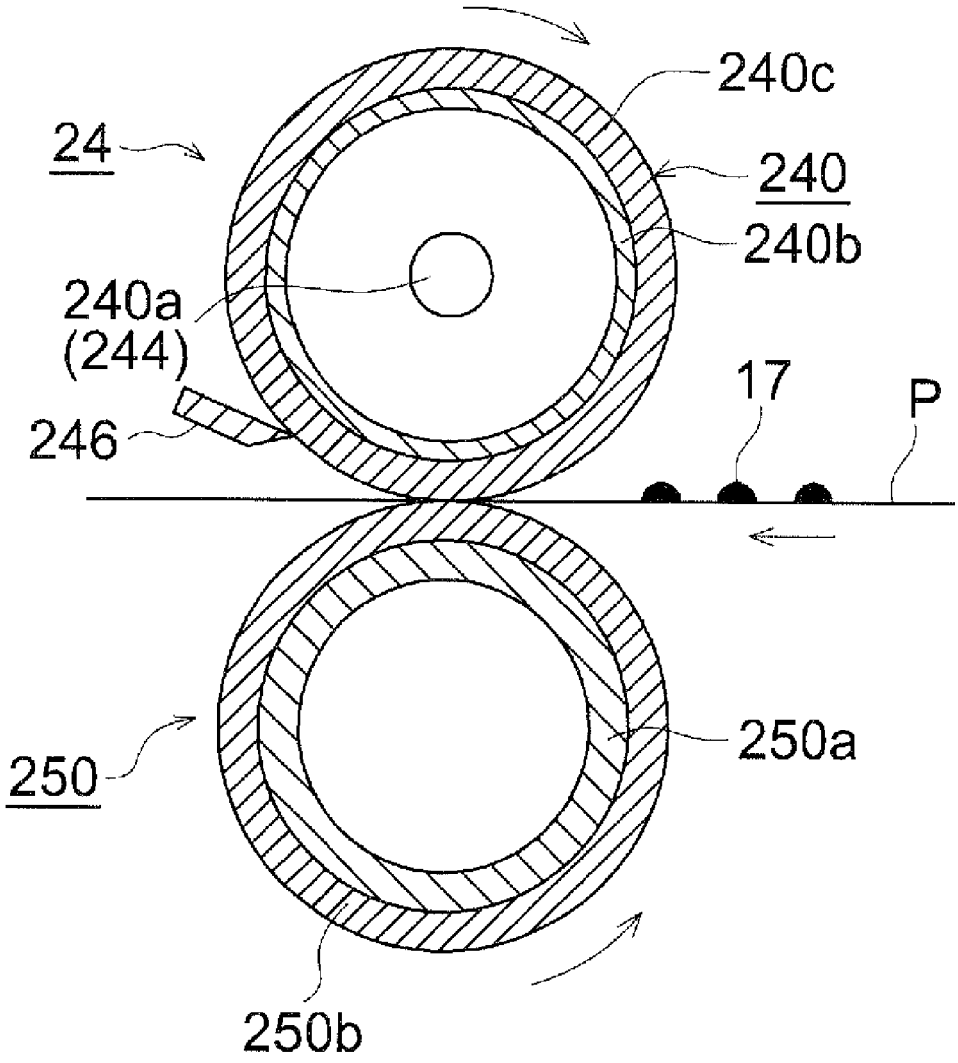
FIG. 2 is a schematic view showing an example of a fixing apparatus using a heat roller.

As specific examples of a fixing device: a fixing device using a heat roller; and a fixing device using a heat roller and a pressure belt, will be described. FIG. 2 is a schematic view showing an example of a fixing apparatus using a heat roller.

The fixing device 24 shown in FIG. 2 contains a heat roller 240 and a pressure roller 250 abutting the heat roller 240. Incidentally, in FIG. 2, reference numeral 246 denotes a separation nail and P is a paper on which a toner image is formed (transfer sheet).

The heat roller 240 contains a coating layer 240*c* made of a fluorocarbon resin or an elastic body formed on a surface of a cored bar 240*a*, the heat roller 240 further containing a heat member 244 made of a linear heater.

The cored bar 240*a* is composed of a metal and the inner diameter thereof is preferably 10-70 mm. The metal composing the cored bar 240*a* is not specifically limited, and such metals may be listed including, for example, iron, aluminum, copper or alloys of these metals.

The wall thickness of the cored bar 240*a* is preferably 0.1-15 mm, which is determined considering the balance between the requirement of energy saving (making the wall thinner) and the strength (depending on the component materials). For example, in order to keep the strength equivalent to that of the cored bar made of 0.57 mm thickness iron by the cored bar made of aluminum, the thickness of 0.8 mm is required.

As the fluorocarbon resin composing a surface of the coating layer 240*c*, for example, PTFE (polytetrafluoroethylene) and PFA (tetrafluoroetylene-perfluoroalkylvinylether copolymer) may be listed.

The thickness of the coating layer 240*c* made of fluorocarbon resin is preferably 10-500 μm, and more preferably 20-400 μm. When the thickness of the coating layer 240*c* containing fluorocarbon resin is less than 10 μm, the function as the coating layer cannot be adequately performed, so that the durability as the fixing device cannot be assured. On the other hand, the surface of the coating layer over 500 μm tends to have bruises due to paper powders, and the toner or other materials adheres at the bruise portions, causing the problem of image staining.

Further, as the elastic body composing the coating layer 240*c*, a silicon rubber and a silicon sponge rubber having high heat resistance, for example, LTV, RTV and HTV are preferably used.

An Asker C hardness of the elastic body composing the coating layer 240*c* is preferably less than 80°, and more preferably less than 60°.

Further, the thickness of the coating layer 240*c* made of the elastic body is preferably 0.1-30 mm, and more preferably 0.1-20 mm.

As the heat member 244, a halogen heater is preferably used.

The pressure roller 250 contains a coating layer 250*b* made of an elastic body formed on a surface of a cored bar 250*a*. The elastic body composing the coating layer 250*b* is not specifically limited, and various types of soft rubbers and sponge rubbers, for example, polyurethane rubber and silicon rubber are usable. Silicon rubber or silicon sponge rubber are preferably used as a material used for the coating layer 250*b*. Further, the thickness of the coating layer 250*b* is preferably 0.1-30 mm, and more preferably 0.1-20 mm.

Further, the fixing temperature (the surface temperature of the heat roller 10) is preferably 70-210° C., and the fixing linear velocity is preferably 80-640 mm/sec. The nip width of the heat roller is preferably 8-40 mm, and more preferably 11-30 mm.

Separation nail 246 is provided in order to prevent the transfer paper subjected to thermal fixing treatment with heat roller 240 from winding on heat roller 240.

Figure 3:
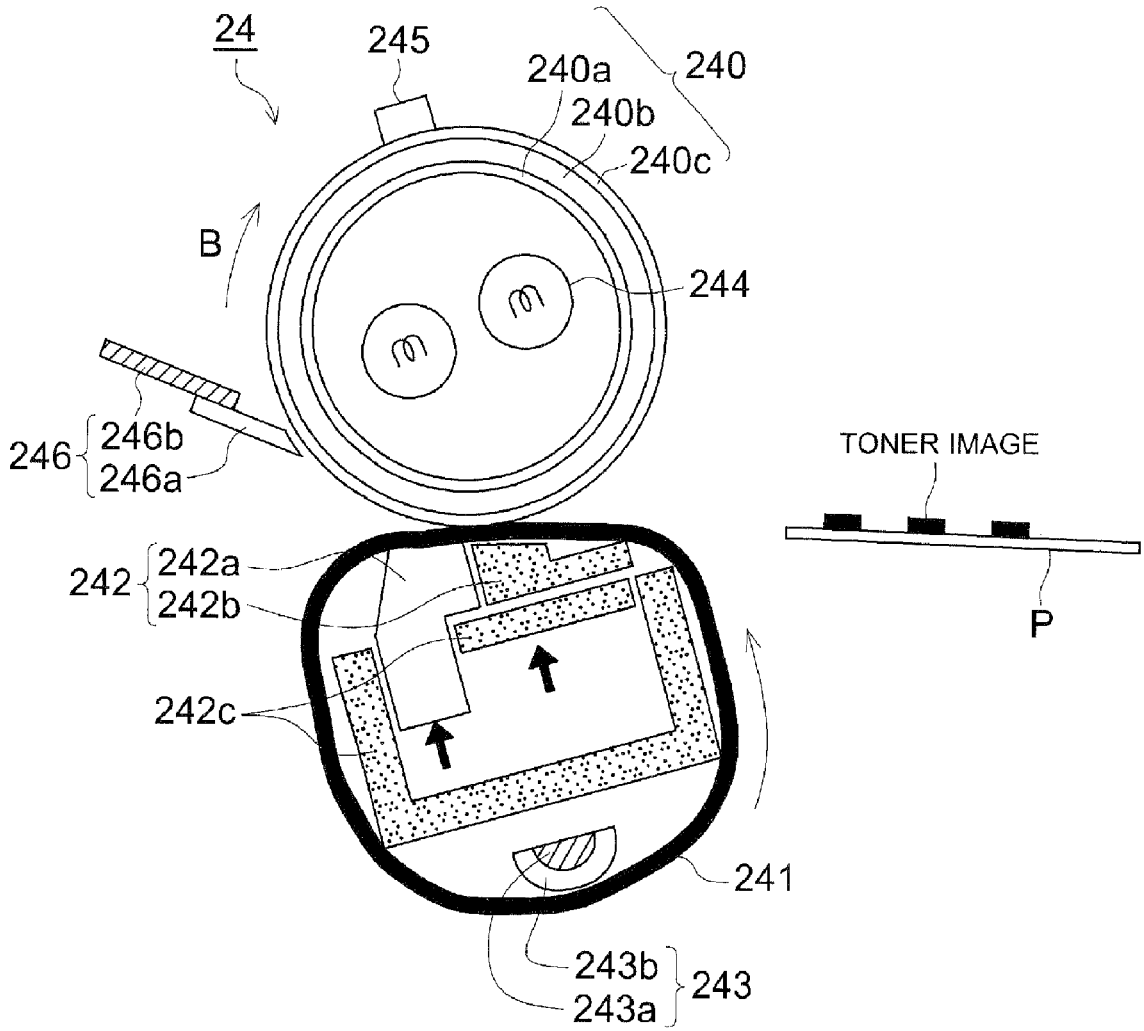
FIG. 3 is a schematic view showing an example of a fixing device using a belt and a heating roller.

Moreover, when the toner of the present invention is employed, it is desirable to use the fixing device which can supply efficiently the heat supplied from a heating member to a paper. It is desirable to specifically use the fixing device containing so called belt fixing method in which a heat-resistant belt is used for either a heating member or a pressure providing member. FIG. 3 is a schematic view showing an example of the fixing device (a type using a belt and a heat roller).

The fixing device 24 shown in FIG. 3 is a type using a belt and the heat roller for keeping the nip width, wherein the key sect on contains a heat roller 240 and a seamless belt 241, a pressure pads (pressure members) 242*a*, 242*b* which are pressed against the heat roller 240 via the seamless belt 241, and a lubricant supplying member 243. B represents the rotation direction of the heat roller 240.

The heat roller 240 contains a heat resistant elastic body layer 240*b* and a releasing layer (heat resistant resin layer) 240*c* which are formed around a metal core (cylindrical cored bar) 240*a*, wherein inside the core 240*a* is provided with the halogen lamp 244 as the heat source. The temperature of a surface of the heat roller 240 is measured with the temperature sensor 245, and the halogen lamp is feedback-controlled by a temperature controller not shown in response to the measured signal, whereby the surface of the heat roller 240 is controlled so that the temperature thereof is constant. The seamless belt 241 is contacted as to be wound by a predetermined angle relative to the heat roller 240 to form a nip section.

Inside the seamless belt 241 is provided with a pressure pad 242 having a low friction layer on a surface thereof in the state of being pressed against the heat roller 240 via the seamless belt 241. The pressure pad 242 contains the pressure pad 242*a* to which a strong nip pressure is applied and the pressure pad 242*b* to which a weak nip pressure is applied, the pressure pads 242*a*, 242*b* being held by a holder 242*c* made of metal or other materials.

The holder 242*c* is further mounted with a belt-travel guide so that the seamless belt 241 can slide and rotate smoothly. Because the belt-travel guide chafes against an inner surface of the seamless belt 241, a member for the belt-travel guide is desired to have a lower friction coefficient and also has a low heat conduction in order not to take the heat away from the seamless belt 241. As a specific example of the material of the seamless belt 241, polyimide is preferably used.

EXAMPLES

The present invention will now be specifically described with reference to examples, however the present invention is not limited to the following description.

1. Toner Preparation via Pulverization Method (Preparation of "Magenta Toner 1")

<Process A>

| | |
|---|---|
| Polyester resin (condensation product, at a weight average molecular weight of 20,000, of bisphenol A ethylene oxide addition product with terephthalic acid and trimellitic acid) | 100 parts by weight |
| Dye (DX-2) | 3 parts by weight |
| Pentaerythritol tetrastearate (wax) | 6 parts by weight |
| Dibenzilic acid boron (charge control agent) | 1 part by weight |

The foresaid compounds were placed in a Henschel mixer (produced by Mitsui Miike Mining Co., Ltd.), and underwent a blending treatment at a peripheral rate of the stirring blade of 25 m/second over 5 minutes. During the above operation, the blending treatment was carried out by feeding chilled water at 9° C. into the jacket of the Henschel mixer, and the treatment was carried out while the temperature of the mixture was maintained at 25° C.

<Process B>

Subsequently, 3.4 parts by weight of Metal Compound (1-2) were placed in the above "Henschel mixer", and underwent a blending treatment at a peripheral rate of the stirring blade of 40 m/second over 30 minutes. During the above operation, a blending treatment was carried out while heated water at 40° C. was fed into the jacket of the Henschel mixer, and the treatment was carried out while the temperature of the mixture was maintained at 47° C.

<Process C>

The resulting mixture underwent a kneading treatment employing a biaxial extrusion kneader while heated at 140° C. The temperature of the kneaded product was 145° C. at the discharge section of the aforesaid kneader. After the kneading treatment, the resulting kneaded product was allowed to stand to cool for 6 hours.

<Pulverization and Classification Process>

When the temperature of the kneaded product reached 28° C., it was coarsely pulverized via a hammer mill, followed by pulverization via a "TURBOMILL PULVERIZER (produced by Turbo Kogyo Co., Ltd.)". Further, fine powder classification treatment was carried out employing an air flow classifier utilizing the Coanda effect, whereby toner particles of a volume based median diameter of 5.4 μm were produced.

<External Additive Treatment Process>

The external additives described below were added to the prepared toner particles. Namely:

| | |
|---|---|
| Silica (average primary particle diameter of 12 nm, treated with hexamethylsilazane) | 0.6 part by weight |
| Titanium dioxide (average primary particle diameter of 24 nm, treated with n-octylsilane) | 0.8 part by weight |

The above compounds were blended under conditions of a stirring blade peripheral rate of 35 m/second, a processing temperature of 35° C., and a processing period of 15 minutes, employing a Henschel mixer (produced by Mitsui Miike Mining Co., Ltd.). Based on the above steps, "Magenta Toner 1" of a volume based median diameter of 5.4 μm was prepared. It was noted that the shape and particle diameter of the above toner particles resulted in no change by the addition of external additives.

(Preparation of "Magenta Toner 2")

"Magenta Toner 2" having a volume based median diameter of 5.5 μm was prepared in the same manner as the above "Magenta Toner 1", except that 3.0 parts by weight of C.I. Pigment Red 122 was used instead of Dye (DX-2) and Metal compound (1-2).

2. Magenta Toner Preparation via Mini-Emulsion Polymerization Aggregation Method (Preparation of "Magenta Toner 3")

2-1. Preparation of Various Dispersions (1) Preparation of Dye Particle Dispersion While stirring, 7.0 parts by weight of sodium n-dodecyl sulfate were placed in 160 parts by weight of ion-exchanged water followed by dissolution, whereby an aqueous surface active solution was prepared. Subsequently, 20 parts by weight of Dye (DX-1) were gradually added to the resulting aqueous surface active agent solution, followed by dispersion employing "CLEARMIX W MOTION CLM-0.8 (produced by M Technique Co.), whereby "Dye Particle Dispersion 1" was produced.

The volume based median diameter of dye particles of "Dye Particle Dispersion 1" was determined, resulting in 292 nm. The volume based median diameter of dye particles were calculated under the following conditions, employing "MICROTRAC UPA-150 (produced by Honeywell Co.).

Determination conditions included:

Sample refractive index: 1.59

Sample specific gravity: 1.05 (in terms of spherical particle)

Solvent refractive index: 1.33

Solvent viscosity: 0.797 (at 30° C.) and 1.002 (at 20° C.)

Zero point adjustment: adjustment was carried out by placing ion-exchanged water in a measurement cell).

(2) Preparation of Metal Compound Particle Dispersion

"Metal Compound Particle Dispersion 1" was prepared using the same steps as the preparation of the above "Dye Particle Dispersion 1", except that Dye (DX-1) was replaced with 17.5 parts by weight of Metal Compound (1-20). The volume based median diameter of metal compound particles of "Metal Compound Particle Dispersion 1" was 320 nm.

2-2. Preparation of Toner Particles (1) Preparation of "Toner Particles 1"

(a) First Step Polymerization

In a reaction vessel fitted with a stirrer, a temperature sensor, a cooling pipe, and a nitrogen introducing unit, an aqueous surface active agent solution was prepared by dissolving 4 parts by weight of the anionic surface active agent (sodium dodecylsulfate) having the following structural formula in 3,040 parts by weight of ion-exchanged water.

Anionic surface active agent; $C_{10}H_{21}(OCH_2CH_2)SO_3Na$

A polymerization initiator solution prepared by dissolving 10 parts by weight of potassium persulfate (KPS) in 40 parts by weight of ion-exchanged water was added to the aforesaid surface active agent solution. After increasing the liquid temperature to 75° C., a polymerizable monomer solution composed of the compounds described below was dripped over one hour.

| | |
|---|---|
| Styrene | 532 parts by weight |
| n-Butyl acrylate | 200 parts by weight |
| Methacrylic acid | 68 parts by weight |
| n-Octylmercaptan | 16.4 parts by weight |

After dripping the aforesaid polymerizable monomer solution, polymerization reaction (first step polymerization) underwent while stirred and heated at 75° C. for two hours, whereby "Resin Particle Dispersion (1H)" incorporating "Resin Particles (1h)" was prepared. The weight average molecular weight of formed "Resin Particles (1h)" was 16,500.

(b) Second Step Polymerization

| | |
|---|---|
| Styrene | 101.1 parts by weight |
| n-Butyl acrylate | 62.2 parts by weight |
| Methacrylic acid | 12.3 parts by weight |
| n-Octylmercaptan | 1.75 parts by weight |

The aforesaid compounds were placed in a flask fitted with a stirrer, and a polymerizable monomer solution was prepared. Thereafter, the following wax was added: Paraffin wax "HNP-57 (produced by Nippon Seiro Co., Ltd) 93.8 parts by weight. By heating the interior to 90° C., the aforesaid wax was dissolved, whereby a monomer solution incorporating the paraffin wax was prepared.

Separately, an aqueous surface active agent solution was prepared by dissolving 3 parts by weight of the anionic surface active agent employed in the aforesaid first step polymerization at 1,560 parts by weight of ion-exchanged water, and was heated so that the internal temperature reached 98° C. Subsequently, added to the above surface active agent solution were 32.8 parts by weight (in terms of solids) of the aforesaid "Resin Particles (1h)" and further, the monomer solution incorporating the aforesaid paraffin wax. Thereafter, by employing a mechanical homogenizer "CLEARMIX, produced by M Technique Co., a mixing and dispersing treatment was carried out over 8 hours, whereby an oil droplet dispersion incorporating oil droplets at a dispersed particle diameter of 340 nm was prepared.

Subsequently, to the aforesaid oil droplet dispersion, added was a polymerization initiator solution prepared by dissolving 6 parts by weight of potassium persulfate to 200 parts by weight of ion-exchanged water. The resulting mixture was heated at 98° C. for 12 hours while stirred, whereby a polymerization reaction (a second step polymerization) underwent. Via the aforesaid polymerization reaction, "Resin Particle Dispersion (1HM)" incorporating "Resin Pericles (1hm)" was prepared. The weight average molecular weight of formed "Resin Particles (1hm)" was 23,000.

(c) Third Step Polymerization

A polymerization initiator solution prepared by dissolving 5.45 parts by weight of potassium persulfate in 220 parts by weight of ion-exchanged water was added to "Resin Particle Dispersion (1HM)" formed via the aforesaid second step polymerization, and a polymerizable monomer solution, composed of the compounds described below, was dripped over one hour under the temperature condition of 80° C.:

| | |
|---|---|
| Styrene | 293.8 parts by weight |
| n-Butyl acrylate | 154.1 parts by weight |
| n-Octylmercaptan | 7.08 parts by weight |

After dripping the aforesaid polymerizable monomer solution, a polymerization reaction (a third step polymerization) underwent by heating and stirring over two hours. Thereafter, the temperature was lowered to 28° C., whereby "Resin Particle Dispersion 1" incorporating "Resin Particles 1" was prepared. The weight average molecular weight of formed "Resin Particles 1" was 26,800.

(2) Preparation of "Toner Particles 3"

(a) Aggregation and Fusion Process

Into a reaction vessel fitted with a stirrer, a temperature sensor, a cooling pipe, and a nitrogen introducing unit, placed were:

| | |
|---|---|
| Resin Particles 1 | 420.7 parts by weight (in terms of solids) |
| Ion-exchanged water | 500 parts by weight |
| Dye Particle Dispersion 1 | 4.2 parts by weight (in terms of solids) |

and after regulating the interior to 30° C. while stirring, the pH was regulated to 10 by the addition of a 5 mol/liter aqueous potassium hydroxide solution.

Subsequently, an aqueous solution, prepared by dissolving 2 parts by weight of magnesium chloride hexahydrate in 1,000 parts by weight of water, was added at 30° C. while stirred over 10 minutes. After the addition, the resulting mixture was allowed to stand for three minutes, followed by further heating. The temperature of the above system was increased to 75° C. over 60 minutes. At this condition, 4.5 parts by weight (in terms of solids) of "Metal Compound Particle Dispersion 1" was added.

Subsequently, the average diameter of aggregated particles was determined via "COULTER MULTISIZER 3 (produced by Beckmann Coulter Co.), and when the volume based median diameter reached 6.5 μm, an aqueous solution prepared by dissolving 8.2 parts by weight of sodium chloride in 50 parts by weight of ion-exchanged water was added, and particle growth was terminated.

Further, the liquid temperature was regulated to 80° C., and fusion was allowed to continue via heating and stirring over 4 hours, whereby "Toner Particle Dispersion 1" was prepared. With regard to "Toner Particle Dispersion 1", the average circularity of toner particles was determined employing "FPIA2100 (produced by Sysmex Corp.), resulting in 0.940.

(b) Washing and Drying Process

Subsequently, prepared "Toner Particle Dispersion 1" was cooled was under a temperature decreasing rate of 8° C./minute to become 30° C. Then cooled "Toner Particle Dispersion 1" was filtered and washed several times with ion-exchanged water at 45° C. After the washing process, drying was carried out via an air flow of 40° C., whereby "Toner Particles 3" having a volume based median diameter of 6.2 μm was prepared.

(3) External Addition Process

To prepared "Toner Particles 3" were added the following external additives:

| | |
|---|---|
| hexamethylsilazane-treated silica (at an average primary particle diameter of 12 nm) | 0.6 part by weight |
| and | |
| n-octylsilane-treated titanium dioxide (at an average primary particle diameter Of 24 nm) | 0.8 part by weight. |

External addition processes were carried out in such a manner that by employing a Henschel mixer (produced by Mitsui Miike Mining Co., Ltd.), mixing was performed under conditions of a stirring blade peripheral rate of 35 m/second, a processing temperature of 35° C., and a processing period of 15 minutes. As described previously, "Magenta Toner 3" was prepared. It was noted that prepared "Magenta Toner 3" resulted in no change of the shape and the particle diameter prior to and after the aforesaid external addition processes.

(Preparation of "Magenta Toners 4-18")

Each of "Magenta Toners 4-18" was prepared in the same manner as the aforesaid "Magenta Toner 3", except that the dyes, the metal compounds, and their amounts were changed as listed in Table 2.

(Preparation of "Magenta Toners 19")

Comparative "Magenta Toner 19" was prepared in the same manner as the aforesaid "Magenta Toner 3", except that 20 parts by weight of C.I. Pigment Red 122 was used instead of Dye (DX-1) and Metal compound (1-20).

(Preparation of "Magenta Developers 1-19")

To each of Magenta Toners 1-19 was added a ferrite carrier covered with a silicone resin on the surface thereof and having a volume average particle diameter of 60 μm in such a manner that a content of each Magenta Toner is 6 weight %. Thus Magenta Developers 1-19 were prepared.

In Table 1, listed are the dyes represented by Formula (X-1) and the metal compounds represented by Formula (1), all of which were employed to prepare "Magenta Developers (Toners) 1-19".

TABLE 2

| Magenta Developer | Dye | | Metal Compound | | Toner |
|---|---|---|---|---|---|
| (Toner) No. | Kind | Added Amount | Kind | Added Amount | Preparation Method |
| 1 | DX-2 | 3.0 | 1-2 | 3.4 | Pulverization Method |
| 2 | P.R.122 | 3.0 | — | — | Pulverization Method |
| 3 | DX-1 | 20.0 | 1-20 | 17.5 | *1 |
| 4 | DX-3 | 21.0 | 1-1 | 25.0 | *1 |
| 5 | DX-5 | 18.0 | 1-36 | 22.0 | *1 |
| 6 | DX-4 | 22.0 | 1-6 | 20.5 | *1 |
| 7 | DX-6 | 20.5 | 1-3 | 18.0 | *1 |
| 8 | DX-7 | 19.5 | 1-14 | 20.5 | *1 |
| 9 | DX-8 | 20.0 | 1-17 | 22.0 | *1 |
| 10 | DX-10 | 15.0 | 1-8 | 18.0 | *1 |
| 11 | DX-11 | 16.0 | 1-23 | 20.5 | *1 |
| 12 | DX-12 | 17.5 | 1-10 | 19.5 | *1 |

TABLE 2-continued

| Magenta Developer (Toner) No. | Dye Kind | Dye Added Amount | Metal Compound Kind | Metal Compound Added Amount | Toner Preparation Method |
|---|---|---|---|---|---|
| 13 | DX-13 | 25.0 | 1-30 | 20.0 | *1 |
| 14 | DX-15 | 12.5 | 1-33 | 15.0 | *1 |
| 15 | DX-17 | 18.0 | 1-5 | 16.0 | *1 |
| 16 | DX-19 | 16.0 | 1-11 | 17.5 | *1 |
| 17 | DX-20 | 20.0 | 1-21 | 25.0 | *1 |
| 18 | DX-22 | 20.5 | 1-37 | 20.5 | *1 |
| 19 | P.R.122 | 3.0 | — | — | *1 |

P.R.122 = C.I. Pigment Red 122

*1: Mini-Emulsion Polymerization Aggregation Method

3. Preparation of "Cyan Developing Agents 1 to 19"

3-1. Production of "Cyan Toners 1 and 2" by Pulverizing Method

"Cyan toner 1" was produced in the same procedure as the production of above "magenta toner 1", except that dye (DX-2) and metal compound (1-2) were changed to 5.0 parts by mass of silicone phthalocyanine compound (I-1). Further, "cyan toner 2" was produced in the same procedure as the production of above "magenta toner 1", except that dye (DX-2) and metal compound (1-2) were changed to 5.5 parts by mass of "C.I. Pigment Blue 15:3".

3-2. Production of "Cyan Toners 3 to 19" by Mini Emulsion Polymerization and Coagulation Method (1) Production of "Cyan Toner 3"

First, "dye particle dispersion C1" was prepared in the same procedure as the preparation of "dye particle dispersion 1" employed in the production of above "magenta toner 3", except that dye (DX-1) was changed to silicone phthalocyanine compound (I-17).

Next, "cyan toner 3" was produced in the same procedure as the production of above "magenta toner 3", except that "dye particle dispersion 1" and "metal compound particle dispersion 1" employed for the formation of the toner particles were changed to above "dye particle dispersion C1".

(2) Production of "Cyan Toners 4 to 18"

Each cyan toner was produced in the same procedure as the production of above "cyan toner 3", except that the kind and the additive amount of the silicone phthalocyanine compound were changed to those described in Table 3. The cyan toners thus produced were designated as "cyan toners 4 to 18".

(3) Production of "Cyan Toner 19"

"Cyan toner 19" for a comparison was produced in the same procedure as the production of above "cyan toner 3", except that silicone phthalocyanine (I-17) was changed to 23 parts by mass of C.I. Pigment Blue 15:3.

(4) Preparation of "Cyan Developing Agents 1 to 19"

Ferrite carriers exhibiting a volume-average particle size of 60 μm, which are covered with silicone resins, were blended into each of above "cyan toners 1 to 19" to a concentration of 6% by mass of a cyan toner, to prepare "cyan developing agents 1 to 19". The kind and the additive amount of the silicone phthalocyanine metal compound employed in the production of above "cyan developing agents (toners) 1 to 19" are given in Table 3.

TABLE 3

| Cyan Developing Agent (Cyan Toner) No. | Cyan Coloring Agent No. | Additive Amount | Toner Production Method |
|---|---|---|---|
| 1 | I-1 | 5.5 | Pulverizing Method |
| 2 | P.B.15:3 | 5.5 | Pulverizing Method |
| 3 | I-17 | 20.0 | *1 |
| 4 | I-3 | 21.0 | *1 |
| 5 | I-4 | 22.0 | *1 |
| 6 | I-15 | 18.0 | *1 |
| 7 | I-7 | 20.5 | *1 |
| 8 | I-8 | 19.5 | *1 |
| 9 | I-9 | 20.0 | *1 |
| 10 | I-10 | 15.0 | *1 |
| 11 | I-11 | 16.0 | *1 |
| 12 | I-13 | 17.5 | *1 |
| 13 | I-5 | 25.0 | *1 |
| 14 | I-7 | 18.5 | *1 |
| 15 | I-19 | 16.5 | *1 |
| 16 | I-21 | 18.0 | *1 |
| 17 | I-12 | 17.5 | *1 |
| 18 | P.B.15:3 | 23.0 | *1 |
| 19 | I-15 | 19.5 | *1 |

P.B.15:3 = C.I. Pigment Blue 15:3

*1: Mini Emulsion Coagulation Method

4. Preparation of "Yellow Developing Agents 1 to 19"

4-1. Production of "Yellow Toners 1 and 2" by Pulverizing Method

"Yellow toner 1" was produced in the same procedure as the production of above "magenta toner 1", except that dye (DX-2) and metal compound (1-2) were changed to the following pigments:

| | |
|---|---|
| C.I. Pigment Yellow 74 | 4.8 parts by mass |
| C.I. Pigment Yellow 139 | 0.5 parts by mass |

Further, "yellow toner 2" was produced in the same procedure as the production of above "magenta toner 1", except that dye (DX-2) and metal compound (1-2) were changed to 5.5 parts by mass of "C.I. Pigment Yellow 74".

4-2. Production of "Yellow Toners 3 to 19" by Mini Emulsion Polymerization and Coagulation Method (1) Production of "Yellow Toner 3"

First, "dye particle dispersion Y1" was prepared in the same procedure as the preparation of "dye particle dispersion 1" employed in the production of above "magenta toner 3", except that dye (DX-1) was changed to the following pigments:

| | |
|---|---|
| C.I. Pigment Yellow 74 | 15 parts by mass |
| C.I. Pigment Yellow 83 | 10 parts by mass |

Next, "yellow toner 3" was produced in the same procedure as the production of above "magenta toner 3", except that "dye particle dispersion 1" and "metal compound particle dispersion 1" employed for the formation of the toner particles were changed to above "dye particle dispersion Y1".

(2) Production of "Yellow Toners 4 to 18"

Each yellow toner was produced in the same procedure as the production of above "yellow toner 3", except that the kind and the additive amount of the yellow pigment were changed to those given in Table 4. The yellow toners thus produced were designated as "yellow toners 4 to 18".

(3) Production of "Yellow Toner 19"

"Yellow toner 19" for a comparison was produced in the same procedure as the production of above "yellow toner 3", except that "dye particle dispersion Y1" was changed to "dye particle dispersion Y17" composed of the pigment below.

C.I. Pigment Yellow 74 23 parts by mass (4) Preparation of "Yellow Developing Agents 1 to 19"

Ferrite carriers exhibiting a volume-average particle size of 60 μm, which are covered with silicone resins, were blended into each of above "yellow toners 1 to 19" to a concentration of 6% by mass of a yellow toner, to prepare "yellow developing agents 1 to 19". The kind, the additive amount, and the ratio of yellow pigment employed in the production of above "yellow developing agents (toners) 1 to 19" are given in Table 4.

TABLE 4

| Yellow Developing Agent (Yellow Toner) No. | Yellow Pigment Y1 Kind | Y1 Additive Amount | Y2 Kind | Y2 Additive Amount | Ratio by Mass Y1:Y2 | Toner Production Method |
|---|---|---|---|---|---|---|
| 1 | P.Y.74 | 4.8 | P.Y.139 | 0.5 | 90:10 | Pulverizing Method |
| 2 | P.Y.74 | 5.5 | — | — | 100:0 | Pulverizing Method |
| 3 | P.Y.74 | 15.0 | P.Y.155 | 10.0 | 60:40 | *1 |
| 4 | P.Y.74 | 2.5 | P.Y.185 | 22.5 | 10:90 | *1 |
| 5 | P.Y.74 | 22.5 | P.Y.139 | 2.5 | 90:10 | *1 |
| 6 | P.Y.74 | 5.0 | P.Y.139 | 20.0 | 20:80 | *1 |
| 7 | P.Y.74 | 2.5 | P.Y.139 | 22.5 | 10:90 | *1 |
| 8 | P.Y.180 | 22.5 | P.Y.185 | 2.5 | 90:10 | *1 |
| 9 | P.Y.139 | 22.5 | P.Y.180 | 2.5 | 90:10 | *1 |
| 10 | P.Y.139 | 12.5 | P.Y.155 | 12.5 | 50:50 | *1 |
| 11 | P.Y.111 | 19.5 | P.Y.155 | 5.5 | 78:22 | *1 |
| 12 | P.Y.155 | 12.5 | P.Y.180 | 12.5 | 50:50 | *1 |
| 13 | P.Y.139 | 20.0 | P.Y.185 | 5.0 | 80:20 | *1 |
| 14 | P.Y.180 | 17.5 | P.Y.139 | 7.5 | 70:30 | *1 |
| 15 | P.Y.111 | 22.5 | P.Y.153 | 2.5 | 90:10 | *1 |
| 16 | P.Y.139 | 12.5 | P.Y.74 | 12.5 | 50:50 | *1 |
| 17 | P.Y.155 | 20.0 | P.Y.185 | 5.0 | 80:20 | *1 |
| 18 | P.Y.17 | 20.0 | P.Y.180 | 5.0 | 80:20 | *1 |
| 19 | P.Y.17 | 23.0 | — | — | 100:0 | *1 |

P.I. = C.I. Pigment Yellow

*1: Mini Emulsion Coagulation Method

5. Evaluation Experiment

By combining above-described "magenta developing agents to 19", "cyan developing agents 1 to 19", "yellow developing agents 1 to 19", and a commercially available black toner, 19 kinds of full color kits as shown in Table 5 were prepared. The kits employing developing agents 1 and 3 to 18, and the kits employing developing agents 2 and 19 are designated as "Examples 1 to 17" and "Comparative Examples 1 and 2", respectively.

TABLE 5

| | Developing Agent Y | M | C | Toner Production Method |
|---|---|---|---|---|
| Example 1 | 1 | 1 | 1 | Pulverizing Method |
| Example 2 | 3 | 3 | 3 | *1 |
| Example 3 | 4 | 4 | 4 | *1 |
| Example 4 | 5 | 5 | 5 | *1 |
| Example 5 | 6 | 6 | 6 | *1 |
| Example 6 | 7 | 7 | 7 | *1 |
| Example 7 | 8 | 8 | 8 | *1 |
| Example 8 | 9 | 9 | 9 | *1 |
| Example 9 | 10 | 10 | 10 | *1 |

TABLE 5-continued

| | Developing Agent Y | M | C | Toner Production Method |
|---|---|---|---|---|
| Example 10 | 11 | 11 | 11 | *1 |
| Example 11 | 12 | 12 | 12 | *1 |
| Example 12 | 13 | 13 | 13 | *1 |
| Example 13 | 14 | 14 | 14 | *1 |
| Example 14 | 17 | 15 | 15 | *1 |
| Example 15 | 16 | 16 | 16 | *1 |
| Example 16 | 17 | 17 | 17 | *1 |
| Example 17 | 18 | 18 | 17 | *1 |
| Comparative Example 1 | 2 | 2 | 2 | Pulverizing Method |

TABLE 5-continued

| | Developing Agent Y | M | C | Toner Production Method |
|---|---|---|---|---|
| Comparative Example 2 | 19 | 19 | 19 | *1 |

*1: Mini Emulsion Coagulation Method

For evaluations, a fixing device constituted of a heat roller and a pressure belt as shown in FIG. 3, which was set to the conditions that (1) fixing temperature is 190 to 210° C., (2) fixing speed is 300 mm/sec and (3) transfer sheet is plain paper, was attached to a commercially available digital color copier, "bizhub PRO C6500" (manufactured by Konica Minolta Business Technologies, Inc.), which corresponds to an image forming apparatus of a two-component developing system as shown in FIG. 1.

<Measurement of Color Gamut>

Employing the above "bizhub PRO C6500" (manufactured by Konica Minolta Business Technologies, Inc.), test charts for the color gamut measurement were outputted with the default mode, and then, the outputted test charts for the color gamut measurement were measured via Spectrolina/Scan Bundle (produced by GretagMacbeth, Inc.). The color gamut measurement was carried out in accordance with the following measurement conditions:

Measurement Conditions
Light source: D50
Observing angle: 2°
Density: ANSI T
White reference: Abs
Filter: UV Cut
Measurement mode: reflectance
Language: Japanese <Color Gamut Balance and Sensory Evaluation of Image>

In order to compare a color gamut balance based on data obtained at the above <Measurement of Color Gamut>, chromas at every 90 degrees of hue, that is, at 45 degrees, at 135 degrees, at 225 degrees, and at 315 degrees, are given in Table 6. Further, as a comparison, data of sRGB are given in Table 6.

Test charts for the color sensory test were outputted with similar toner combinations employing the above commercially available digital copier "bizhub PRO C6500" (manufactured by Konica Minolta Business Technologies, Inc.). Visual sensory evaluations were carried out using the above test charts by 50 persons, and images were scored in accordance with the following criteria:

4 points: The image looks beautiful.
3 points: The image looks somewhat beautiful.
2 points: The image gives an average impression.
1 point: The image has a color imbalance.

The results are shown in Table 6.

TABLE 6

| | Evaluation Result | | | | | |
|---|---|---|---|---|---|---|
| | Area of Color Gamut (Index) | Chroma at Hue Angle of 45° | Chroma at Hue Angle of 135° | Chroma at Hue Angle of 225° | Chroma at Hue Angle of 315° | Sensory Test of Image (Score) |
| Example 1 | 133 | 82 | 87 | 58 | 91 | 190 |
| Example 2 | 133 | 78 | 85 | 58 | 93 | 191 |
| Example 3 | 134 | 79 | 87 | 57 | 95 | 198 |
| Example 4 | 132 | 80 | 84 | 56 | 91 | 193 |
| Example 5 | 131 | 80 | 85 | 57 | 91 | 184 |
| Example 6 | 133 | 78 | 85 | 59 | 92 | 188 |
| Example 7 | 134 | 79 | 86 | 58 | 93 | 198 |
| Example 8 | 133 | 82 | 87 | 57 | 95 | 182 |
| Example 9 | 135 | 80 | 84 | 56 | 91 | 189 |
| Example 10 | 130 | 80 | 85 | 57 | 92 | 188 |
| Example 11 | 132 | 79 | 86 | 58 | 91 | 183 |
| Example 12 | 133 | 80 | 86 | 55 | 92 | 180 |
| Example 13 | 131 | 80 | 87 | 58 | 91 | 189 |
| Example 14 | 130 | 84 | 86 | 56 | 93 | 183 |
| Example 15 | 134 | 80 | 85 | 58 | 92 | 182 |
| Example 16 | 133 | 79 | 84 | 58 | 91 | 181 |
| Example 17 | 135 | 80 | 85 | 56 | 90 | 185 |
| Comparative Example 1 | 99 | 79 | 79 | 58 | 70 | 74 |
| Comparative Example 2 | 100 | 78 | 74 | 57 | 78 | 82 |
| | Color Gamut of sRGB→ | 100 | 120 | 40 | 120 | |

As shown from the results in Table 6, any prints made of "Examples 1 to 17", which fill structures of the image forming methods of the present invention, resulted in larger color gamut, compared to prints made of "Comparative Examples 1 and 2", in which toners employing conventional coloring materials were combined. Further, the above prints exhibited color gamuts with a better color balance compared to those of sRGB, leading to excellent results in the sensory tests.

What is claimed is:

1. A set of toners comprising a yellow toner, a magenta toner, a cyan toner and a black toner for forming a full color image with an electrophotographic method, wherein the yellow toner comprises toner particles containing at least one pigment selected from the group consisting of C.I. Pigment Yellow 74, C.I. Pigment Yellow 139, C.I. Pigment Yellow 155, C.I. Pigment Yellow 180 and C.I. Pigment Yellow 185;

the magenta toner comprises toner particles containing a dye represented by Formula (X-1) and a metal compound represented by Formula (1); and the cyan toner comprises toner particles containing a silicon phthalocyanine represented by Formula (2):

Formula (X-1)

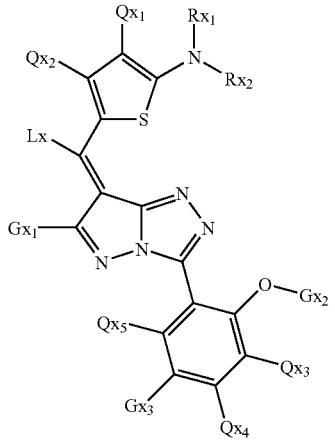

wherein, $Rx_1$ and $Rx_2$ each independently represent an alkyl group; Lx represents a hydrogen atom or an alkyl group; $Gx_1$ represents an alkyl group of 2 or more carbon atoms; $Gx_2$ represents an alkyl group or an aromatic hydrocarbon; $Gx_3$ represents a hydrogen atom, a halogen atom, $Gx_4$ —CO—NH—, or $Gx_5$ —N($Gx_6$)—CO—, provided that $Gx_4$ is substituent, and $Gx_5$ and $Gx_6$ each independently represents a hydrogen atom or a substituent; and $Qx_1$, $Qx_2$, $Qx_3$, $Qx_4$, $Qx_5$ each independently represents a hydrogen atom or a substituent, Formula (1)

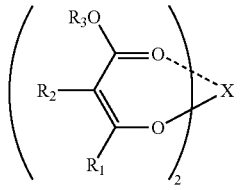

wherein, $R_1$ and $R_2$ each independently represent a hydrogen atom, an alkyl group, an alkenyl group, a alkynyl group, an aryl group, a heterocyclic group, an alkoxycarbonyl group, an aryloxycarbonyl group, a sulfamoyl group, a sulfinyl group, an alkylsulfonyl group, a arylsulfonyl group, a cyano group, a trifluoroalkyl group or a nitro group, provided that one of $R_1$ and $R_2$ is an electron withdrawing group; $R_3$ represents an alkyl group, an alkenyl group, an alkynyl group, an aryl group or a heterocyclic group, provided that a group represented by $R_3$ contains 3 carbon atoms or more; and X represents Cu, Ni, or Co, Formula (2)

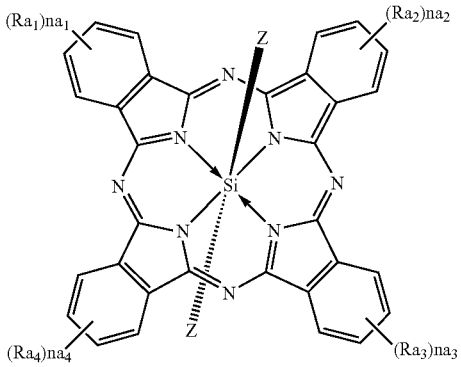

wherein, Z represents a hydroxyl group, a chlorine atom, an aryloxy group of 6 to 18 carbon atoms, an alkoxyl group of 1 to 22 carbon atoms or a group represented by Formula (IV); $R_{a1}$, $R_{a2}$, $R_{a3}$ and $R_{a4}$ each independently represent a substituent; and $n_{a1}$, $n_{a2}$, $n_{a3}$ and $n_{a4}$ each independently represent an integer of 0 to 4, Formula (IV)

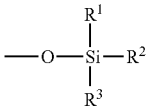

wherein, $R^1$, $R^2$ and $R^3$ each represent an alkyl group of 1 to 22 carbon atoms, an aryl group of 6 to 18 carbon atoms, an alkoxyl group of 1 to 22 carbon atoms or an aryloxy group of 6 to 18 carbon atoms, and $R^1$, $R^2$ and $R^3$ each may be the same or different.

2. The set of toners of claim 1, wherein in Formula (X-1), $Gx_1$ represents a tert-butyl group; $Gx_2$ represents a methyl group or an ethyl group; $Gx_2$ represents a hydrogen atom; and $Qx_1$, $Qx_2$, $Qx_3$, $Qx_4$, $Qx_5$ of each are a hydrogen atom.

3. The set of toners of claim 1, wherein X in Formula (1) represents Cu.

4. The set of toners of claim 1, wherein $n_{a1}$, $n_{a2}$, $n_{a3}$ and $n_{a4}$ in Formula (2) each are 0.

5. The set of toners of claim 1, wherein in Formula (2), Z represents a group represented by Formula (IV) in which $R^1$, $R^2$ and $R^3$ each are a methyl group.

6. An electrophotographic image forming apparatus comprising the set of toners of claim 1.

7. A method for forming a color image using the electrophotographic image forming apparatus of claim 6.

* * * * *